US009693631B2

(12) United States Patent
Jacobs et al.

(10) Patent No.: US 9,693,631 B2
(45) Date of Patent: Jul. 4, 2017

(54) TELESCOPIC SEATING SYSTEMS, AND FOLDABLE CHAIRS AND RELATED COMPONENTS FOR USE WITHIN TELESCOPIC SEATING SYSTEMS

(71) Applicants: Frederick Jacobs, Holland, MI (US); Matthew Jacobs, Holland, MI (US)

(72) Inventors: Frederick Jacobs, Holland, MI (US); Matthew Jacobs, Holland, MI (US)

( * ) Notice: Subject to any disclaimer, the term of this patent is extended or adjusted under 35 U.S.C. 154(b) by 259 days.

(21) Appl. No.: 14/331,404

(22) Filed: Jul. 15, 2014

(65) Prior Publication Data

US 2015/0021964 A1 Jan. 22, 2015

Related U.S. Application Data

(60) Provisional application No. 61/856,013, filed on Jul. 18, 2013, provisional application No. 61/868,547, filed on Aug. 21, 2013, provisional application No. 61/946,824, filed on Mar. 2, 2014, provisional application No. 62/006,363, filed on Jun. 2, 2014, provisional application No. 62/018,854, filed on Jun. 30, 2014.

(51) Int. Cl.

| | |
|---|---|
| ***A47C 1/12*** | (2006.01) |
| ***A47C 1/126*** | (2006.01) |
| ***A47C 1/121*** | (2006.01) |
| ***A47C 4/06*** | (2006.01) |
| ***A47C 7/72*** | (2006.01) |

(52) U.S. Cl.
CPC ..... *A47C 1/126* (2013.01); *A47C 1/121* (2013.01); *A47C 4/06* (2013.01); *A47C 7/72* (2013.01)

(58) Field of Classification Search
CPC ..... A47C 1/126; A47C 1/121; A47C 4/06; A47C 7/72
USPC ..... 297/331, 332, 440.22
See application file for complete search history.

(56) References Cited

U.S. PATENT DOCUMENTS

| | | | | | |
|---|---|---|---|---|---|
| 2,063,836 | A * | 12/1936 | Bromagem | A47C 7/56 | 297/440.22 X |
| 3,464,753 | A * | 9/1969 | Van Ryn | A47C 1/12 | 297/232 |
| 4,063,392 | A * | 12/1977 | Van Ryn | A47C 1/126 | 297/236 |
| 2003/0025372 | A1 * | 2/2003 | Conner | A47C 7/56 | 297/331 X |

* cited by examiner

*Primary Examiner* — Anthony D Barfield
(74) *Attorney, Agent, or Firm* — James E. Shultz, Jr.

(57) ABSTRACT

The telescopic seating systems, and foldable chairs and related components for use within telescopic seating systems, of the present disclosure may incorporate occupant support elements within a space between a top surface of a seat frame structure and a bottom surface of the seat frame structure. Springs may be attached to the top surface of the chair frame structure and configured to extend into the space. Alternatively, or additionally, a chair cushion may extend into the space.

21 Claims, 24 Drawing Sheets

TELESCOPIC SEATING SYSTEMS, AND FOLDABLE CHAIRS AND RELATED COMPONENTS FOR USE WITHIN TELESCOPIC SEATING SYSTEMS

CROSS REFERENCE TO RELATED APPLICATIONS

The present application claims priority under 35 U.S.C. §119(b) to commonly assigned patent application Ser. No. 61/856,013, entitled Telescopic Seating Systems, and Foldable Chairs and Related Components for use within Telescopic Seating Systems, filed Jul. 18, 2013; Ser. No. 61/868,547, entitled Telescopic Seating Systems, and Foldable Chairs and Related Components for use within Telescopic Seating Systems, filed Aug. 21, 2013; Ser. No. 61/946,824, entitled Rocker Style Chairs, Modular Components for use within Rocker Style Chairs and Parts for use within the Modular Components, filed Mar. 2, 2014; Ser. No. 62/006,363, entitled Reconfigurable Seating Systems, Seat Assemblies for use within the Reconfigurable Seating Systems, Components for use within the Seat Assemblies and Parts for use within the Components, filed Jun. 2, 2014; and Ser. No. 62/018,854, entitled Beam Mounted Chair Assemblies, Chair Assemblies for use within the Beam Mounted Chair assemblies, Components for use within the Chair Assemblies and Parts for use within the Components, filed Jun. 30, 2014, the disclosures of which are all incorporated herein in their entireties by reference.

TECHNICAL FIELD

The present disclosure generally relates to telescopic seating systems, and foldable chairs and related components for use within telescopic seating systems. More particularly, the present disclosure relates to occupant support elements within a space between a top surface of a chair frame structure and a bottom surface of the chair frame structure, and to providing power and data connectors within the telescopic seating systems.

BACKGROUND

Telescopic seating systems are often incorporated into gymnasiums, auditoriums, stadiums, theaters, arenas, conference centers, cinemas, places of worship (e.g., a church), education facilities, classrooms, performance halls and the like. The related seating may be bleacher type seating, individual arm chairs, individual chairs with a related work tray or a combination of bleacher seating and individual chairs. In any event, the bleachers and/or individual chairs may be attached to a telescopic structure.

Telescopic seating systems provide flexibility in utilizing related space within gymnasiums, auditoriums, stadiums and the like. When an event requires seating, the telescopic seating system may be extended into the associated space. When an event requires the space for purposes other than seating, the telescopic seating may be stowed away into a compact portion of the space.

Telescopic seating systems and foldable chairs are needed that stow away into a compact space while providing comfortable seating. Furthermore, telescopic seating systems are needed that have power and data connections having interconnecting wires with limited flex points and limited exposure to chair occupants.

SUMMARY

A foldable chair may include a structural frame having a first surface defined by a first side of the structural frame and having a second surface defined by a second side of the structural frame. The foldable chair may further include an occupant support having a spring structure attached to the structural frame that extends into a space that is defined as being below the first surface and being above the second surface. The foldable chair may also include a membrane, attached to the second surface of the structural frame, that limits movement of the spring structure. The foldable chair may also include a cushion, supported by the spring structure, that cooperates with the spring structure to at least partially conform to a portion of a profile of an occupant and that supports the occupant.

In another embodiment, a telescopic seating system may include a plurality of foldable chairs. Each foldable chair may include a structural frame having a first surface defined by a first side of the structural frame and having a second surface defined by a second side of the structural frame. Each foldable chair may also include a membrane, attached to the second surface of the structural frame. Each foldable chair may also include a cushion, supported by the membrane and substantially fills a space defined to be between the first surface and the second surface, that at least partially conforms to a portion of a profile of an occupant and that supports the occupant.

In yet another embodiment, a foldable chair may include a structural frame having a first surface defined by a first side of the structural frame and having a second surface defined by a second side of the structural frame. The foldable chair may also include a membrane, attached to the second surface of the structural frame. The foldable chair may also include a cushion, supported by the membrane and substantially fills a space defined to be between the first surface and the second surface, that at least partially conforms to a portion of a profile of an occupant and that supports the occupant.

In yet a further embodiment, a telescopic seating system may include a power connector and a data connector. The power connector and the data connector may be located within the telescopic seating system such that there is no flex point in the interconnecting wires associated with the individual chairs. The power connector and the data connector may be centrally located between adjacent foldable chairs so that a first occupant of a first foldable chair and a second occupant of a second foldable chair may access the power connector and the data connector.

BRIEF DESCRIPTION OF THE DRAWINGS

The figures described below depict various aspects of telescopic seating systems, and foldable chairs and components for use within the telescopic seating systems disclosed herein. It should be understood that each figure depicts an embodiment of a particular aspect of the disclosed systems, chairs or components, and that each of the figures is intended to accord with a possible embodiment thereof. Furthermore, wherever possible, the following description refers to the reference numerals included in the following figures, in which features depicted in multiple figures may be designated with consistent reference numerals.

DETAILED DESCRIPTION

The telescopic seating systems, and foldable chairs and related components, of the present disclosure provide comfort to a chair occupant while retaining a compact stow away profile. In particular, individual chairs may include a chair occupant support that includes a spring structure that at least partially extends into a space defined by a corresponding chair frame structure. The chair occupant support (e.g., a seat and/or back) may include a cushion, in addition to or in lieu of the spring structure, that at least partially extends into the space defined by the chair frame structure. The chair frame structure may include a membrane that may limit movement of the chair occupant support, may preclude a chair occupant from exposure to pinch points, may provide chair wear resistance and provide chair isolation of a chair occupant from impacts on the chair.

For example, an occupant of a first chair may be isolated from an occupant of a second chair, that is behind the first chair, from pressing on a back side of the first chair. Furthermore, when a chair of the present disclosure is incorporated into a telescopic seating system, the frame structure and membrane may provide rigidity to external chair components (e.g., decorative outer shell components) that impact the corresponding telescopic seating structure and or chair-to-chair impact.

The individual chairs and/or telescopic seating systems of the present disclosure may be installed within gymnasiums, auditoriums, stadiums, theaters, arenas, conference centers, cinemas, places of worship (e.g., a church), education facilities, classrooms, performance halls and the like. The individual chairs of the present disclosure may provide comfort to an occupant while incorporating a low profile back and/or seat. The telescopic seating systems may be provided with power and/or data connections proximate the foldable chairs.

Figure 1A:
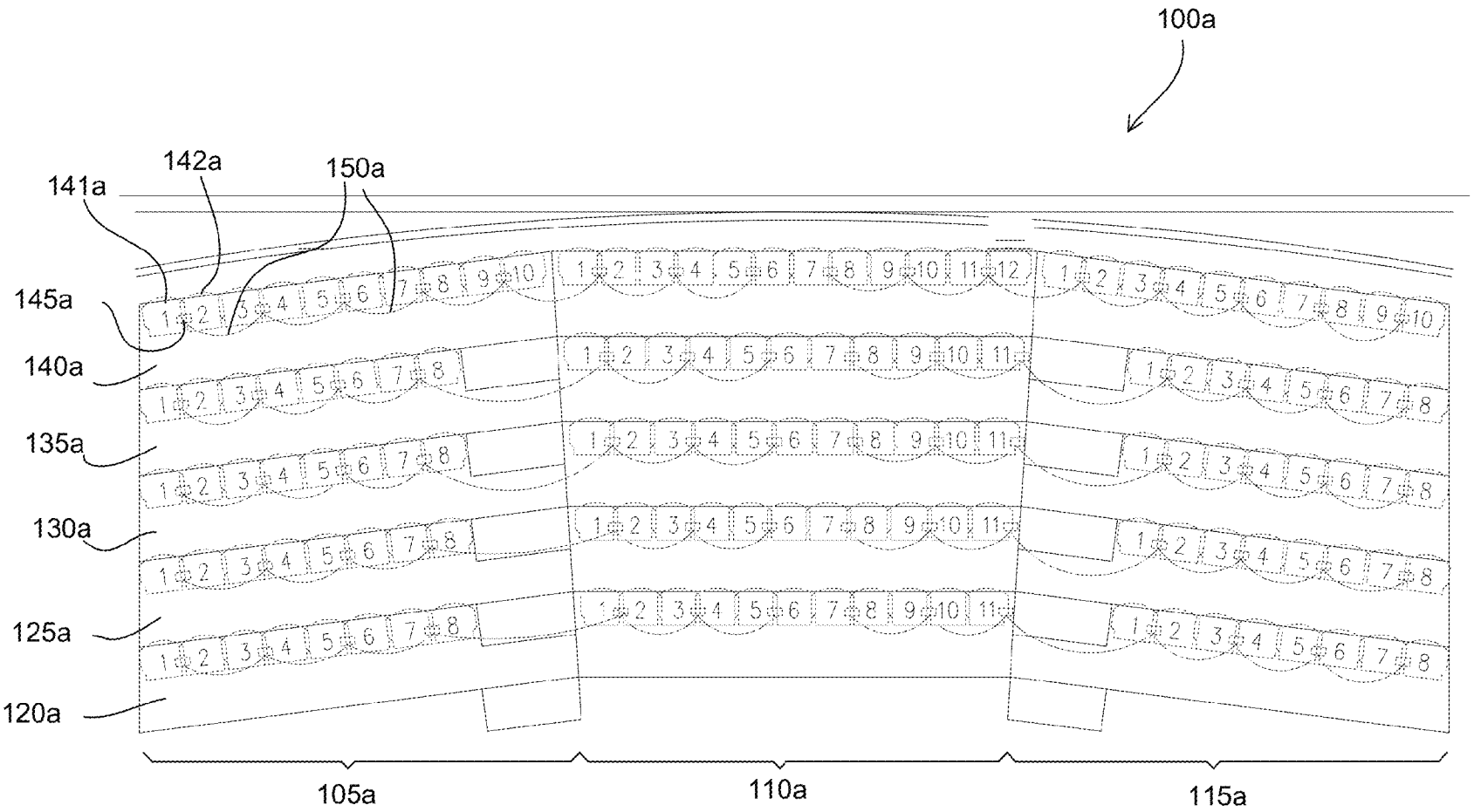
FIG. 1A depicts a plan view of an example telescopic seating system, with integral power and data connections, extended for use.

Turning to FIG. 1A, a plan view of a telescopic seating system 100*a* is depicted expanded and ready for use. The telescopic seating system 100*a* may include a first section 105*a* of foldable chairs 141*a*, 142*a*, a second section 110*a* of foldable chairs 141*a*, 142*a* and a third section 115*a* of foldable chairs 141*a*, 142*a*. Each section 105*a*, 110*a*, 115*a* may include a first row 120*a* of foldable chairs 141*a*, 142*a*, a second row 125*a* of foldable chairs 141*a*, 142*a*, a third row 130*a* of foldable chairs 141*a*, 142*a*, a fourth row 135*a* of foldable chairs 141*a*, 142*a* and a fifth row 140*a* of foldable chairs 141*a*, 142*a*. While the telescopic seating system 100*a* is depicted to include three sections 105*a*, 110*a*, 115*a* and five rows 120*a*, 125*a*, 130*a*, 135*a*, 145*a* of foldable chairs 141*a*, 142*a*, it should be understood that the telescopic seating system 100*a* may include any number of sections and any number of rows of foldable chairs 141*a*, 142*a*. As further depicted in FIG. 1A, the telescopic seating system 100*a* may include power/data connections 145*a* interconnected via wiring 150*a*. The wiring 150*a* may include power conductors that are bundled into a first multi-conductor cable that is separate from second multi-conductor cable that includes the data conductors. Alternatively, the power conductors may be bundled together with the data conductors within a common multi-conductor cable. While FIG. 1A depicts a power/data connection 145*a* located between each set of foldable chairs 141*a*, 142*a*, the telescopic seating system 100*a* may include a power/data connection 145*a* for each foldable chair 141*a* or may include more than two foldable chairs 141*a*, 142*a* per power/data connection 145*a*. Alternatively, or additionally, power/data connections 145*a* may be located in a rear riser, a dust cover, a deck, a nose beam, etc. Associated power/data connections may include on site wiring similar to wiring a building or may be, at least partially, pre-wired connections as done with lecture room tables and panel systems (e.g., as provided by Electri-cable Assemblies or Byrne Electrical Specialists, as discussed below).

The power/data connections 145*a* may provide between approximately 100 Volts and approximately 240 Volts, alternating current (AC), electrical power with between approximately 10 Ampere and 30 Ampere capacity. Each power connection 145*a* may be provided with either a three wire or a four wire interconnection. Each power/data connection 145*a* may be provided with ground fault protection and/or surge protection. The power/data connections 145*a* may provide at least one Ethernet connection, at least one RS-232 connection, at least one universal serial bus (USB) connection, at least one S-video connection, at least one RS-485 connection, at least one telephone connection, at least one broadband connection, a combination thereof, a sub-combination thereof, or any other suitable data connection. While the power/data connections 145*a* are depicted in FIG. 1A as being common to one another, a power connection (e.g., power connection 146*d*) may be separate from a data connection (e.g., data connection 147*d*). Furthermore, any given power connection 146*d* and/or data connection 147*d* may include any number of individual connectors.

Any given power connector 146*d* and/or 147*d* may be, for example, a portion of a Byrne 8-Trac system as available from Byrne Electrical Specialists, Rockford, Mich. Alternatively, or additionally, any given power connector 146*d* and/or 147*d* may be, for example, a portion of a Villa Series, an Oasis UT Series, a Seclusion Series, a Daisylink Series, etc., as available from Electri-cable Assemblies, Shelton, Conn.

Figure 1B:
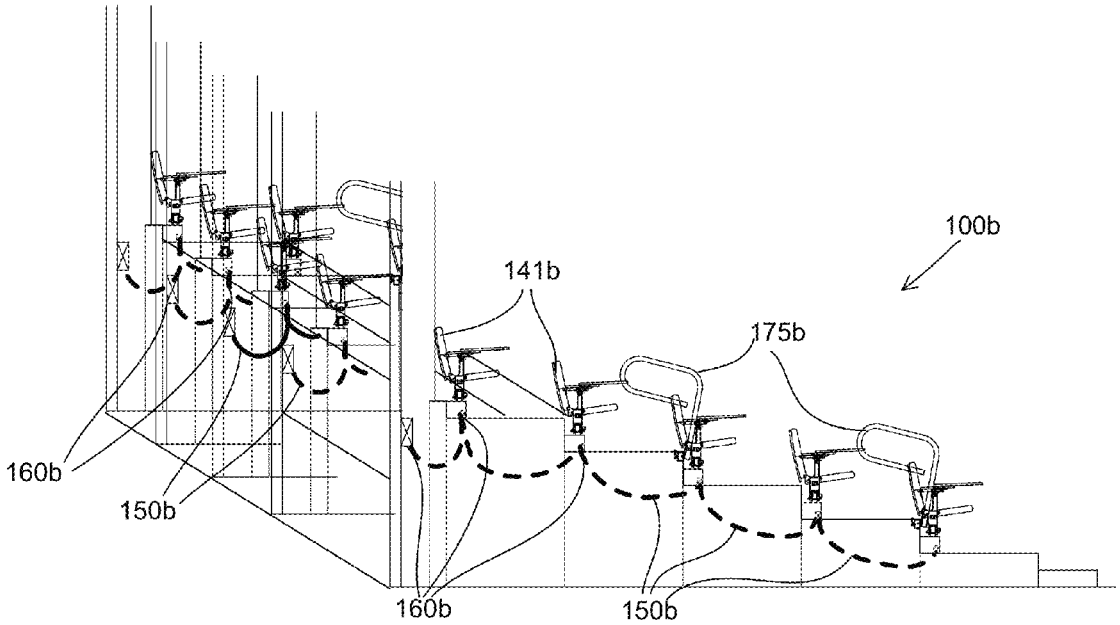
FIG. 1B depicts a profile view of an example telescopic seating system, with integral power and data connections, extended for use.

With reference to FIG. 1B, a profile view of a telescopic seating system 100*b* is depicted expanded and ready for use. The telescopic seating system 100*b* may be similar to the telescopic seating system 100*a* of FIG. 1A. In particular, the telescopic seating system may include a plurality of foldable chairs 141*b*. The telescopic seating system 100*b* may further include hand rails 175*b*. The hand rails 175*b* may be located along walkways within the telescopic seating system 100*b*.

The telescopic seating system 100*b* may also include power/data junction boxes 160*b* having power/data umbilical cords 150*b* extending between the power/data junction boxes 160*b*. For example, a telescopic seating system 100*b* may include one set of power/data junction boxes 160*b* having power/data umbilical cords 150*b* extending underneath an associated structure and between the power/data junction boxes 160*b* (as shown in solid lines on FIG. 1B). Alternatively, a telescopic seating system 100*b* may include a plurality of power/data junction boxes 160*b* having a plurality of power/data umbilical cords 150*b* extending underneath and/or alongside of an associated structure and between the power/data junction boxes 160*b* (as shown in solid/dashed lines on FIG. 1B). Associated wiring to connect power and data outlets may extend from a first outlet in a first row to a second outlet in a second row to a third outlet in a third row, etc. Alternatively, or additionally, associated power/data wiring may extend to a particular row and then run between outlets in the particular row. Connections between power/data outlets and associated junction boxes may be made thru a deck, thru a rear riser, thru a special wire run that is part of a rear riser or thru a nose beam.

Figure 1C:
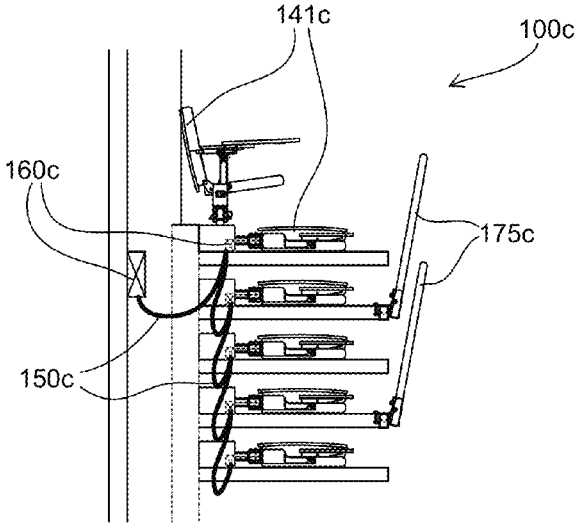
FIG. 1C depicts a profile view of an example telescopic seating system, with integral power and data connections, stowed away.

Turning to FIG. 1C, a profile view of a telescopic seating system 100*b* is depicted stowed away. The telescopic seating system 100*c* may be similar to the telescopic seating system 100*b* of FIG. 1B. In particular, the telescopic seating system may include a plurality of foldable chairs 141*c*. The telescopic seating system 100*c* may further include hand rails 175*c*. The hand rails 175*c* may be folded with respect to the telescopic seating system 100*c* when the telescopic seating system 100*c* is stowed away. The telescopic seating system 100*c* may also include power/data junction boxes 160*c* having power/data umbilical cords 150*c* extending between the power/data junction boxes 160*c*. As can be seen if FIG. 1C, the umbilical cords 150*c* may be configured to droop downward when the telescopic seating system 100*c* is stowed when compared to the umbilical cords 150*b*. The umbilical cords 150*b*, 150*c* may be provided with a protective outer jacket that limits wear and prevents damage to the power/data conductors within the umbilical cords 150*b*, 150*c*.

Figure 1D:
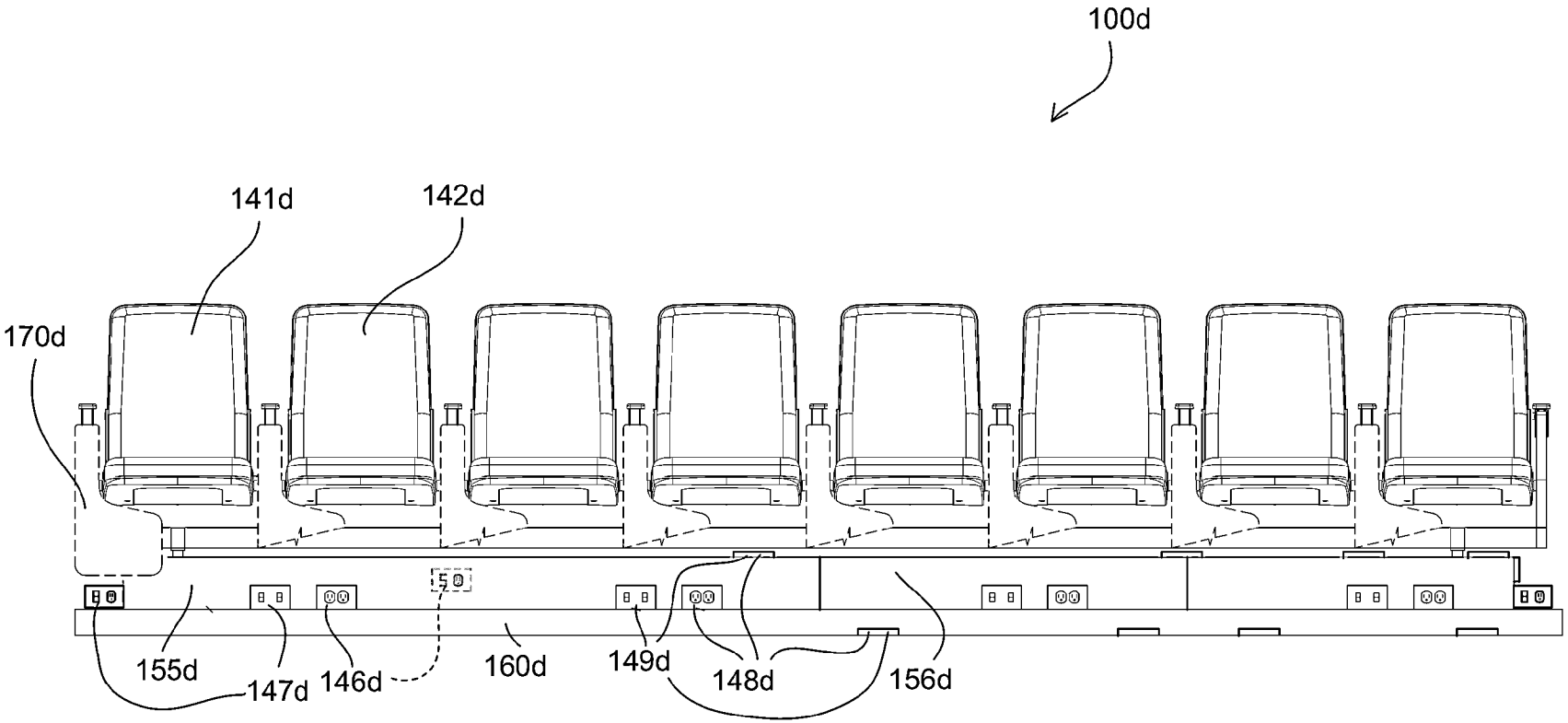
FIG. 1D depicts a profile view of an example row of foldable chairs arranged in a telescopic seating system with integral power and data connections.

With reference to FIG. 1D, a profile view of a row 100*d* of foldable chairs 141*d*, 142*d* may include a first power connector 146*d* and a first data connector 147*d* mounted to a first dust cover 155*d* and a second power connector 148*d* and a second data connector 149*d* mounted to a second dust cover 156*d*. The first power connector 146*d* and the first data connector 147*d* may be centrally located between a first foldable chair 141*d* and a second foldable chair 142*d*. The row 100*d* of foldable chairs 141*d*, 142*d* may also include a power/data conductor raceway 160*d*. The power/data conductor raceway 160*d* may extend between power/data junction boxes (not shown in FIG. 1D).

Figure 1E:
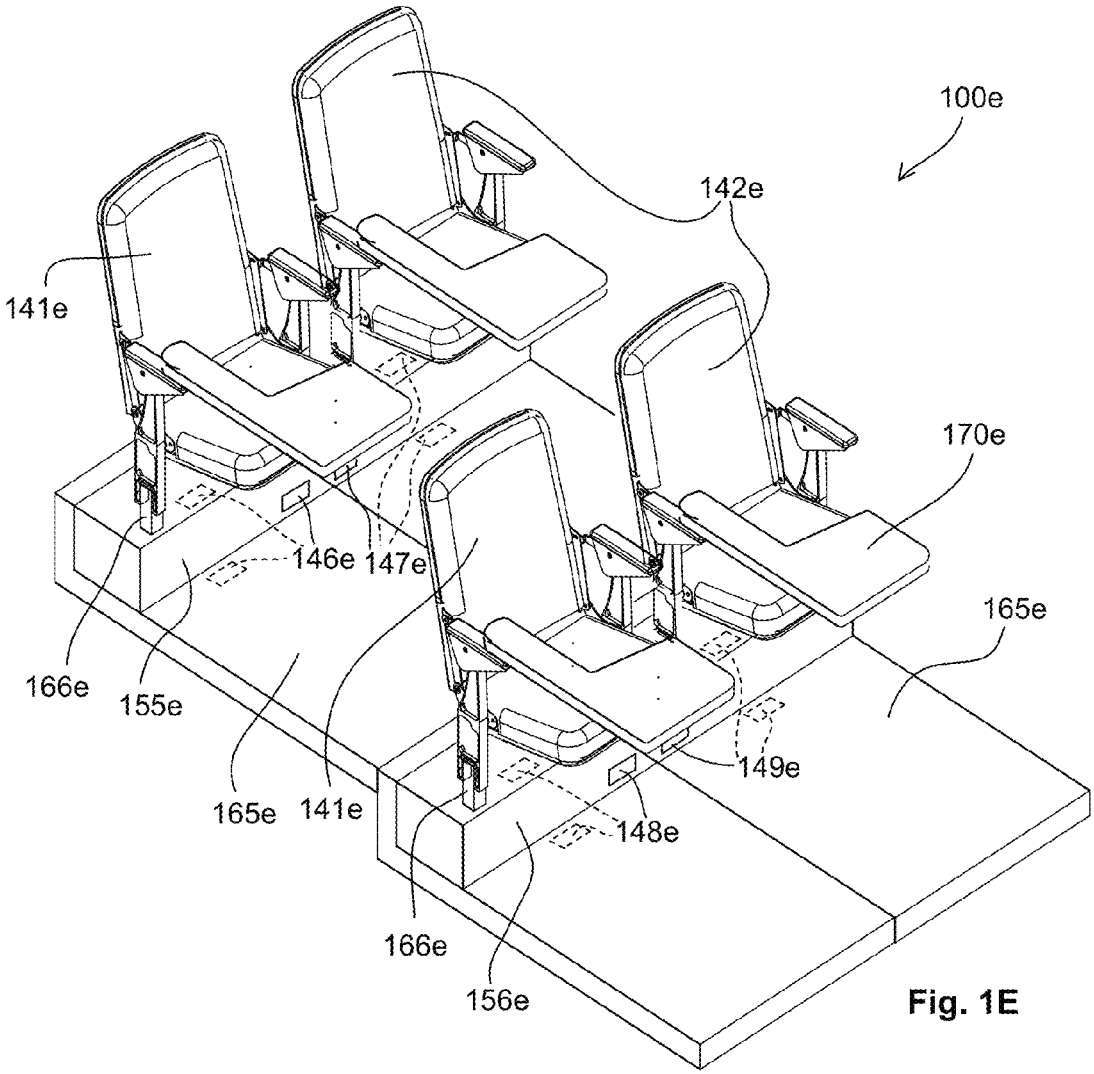
FIG. 1E depicts a perspective view of an example telescopic seating system, with power and data outlets shown in alternate locations, extended for use.

While the power connectors 146*d*, 148*d* and data connectors 147*d*, 149*d* are depicted in FIG. 1D as being mounted on a respective dust cover 155*d*, 156*d*, the power connectors 146*d*, 148*d* and data connectors 147*d*, 149*d* may be mounted to the individual foldable chairs 141*d*, 142*d*. However, mounting the power connectors 146*d*, 148*d* and data connectors 147*d*, 149*d* on a respective dust cover 155*d*, 156*d* (or alternate/additional location as shown in FIGS. 1D and 1E) reduces the number of conductor flex points when compared to mounting the power connectors 146*d*, 148*d* and/or data connectors 147*d*, 149*d* to the individual foldable chairs 141*d*, 142*d*. Alternatively, or additionally, as depicted in FIG. 1D, any given power connector 146*d*, 148*d* and/or any given data connector 147*d*, 149*d* may be located on a top dust cover, on an end dust cover, within a raceway (behind a door, e.g. a self-closing spring loaded door), on a deck plate, or any other suitable location within the associated telescopic seating structure such that a chair occupant has access while setting in an associated chair. Furthermore, individual foldable chairs 141*d*, 142*d* may be less complex when power connectors 146*d*, 148*d* and/or data connectors 147*d*, 149*d* are mounted on a respective dust cover 155*d*, 156*d* (or alternate/additional location as shown in FIGS. 1D and 1E) compared to mounting the power connectors 146*d*, 148*d* and/or data connectors 147*d*, 149*d* to the individual foldable chairs 141*d*, 142*d*. Yet furthermore, exposure of a chair occupant to the power connectors 146*d*, 148*d* and data connectors 147*d*, 149*d* may be reduced when the power connectors 146*d*, 148*d* and/or data connectors 147*d*, 149*d* are mounted on a respective dust cover 155*d*, 156*d* (or alternate/additional location as shown in FIGS. 1D and 1E) compared to mounting the power connectors 146*d*, 148*d* and/or data connectors 147*d*, 149*d* to the individual foldable chairs 141*d*, 142*d*. While the row 100*d* of foldable chairs 141*d*, 142*d* is depicted in FIG. 1D to include a power/data conductor raceway 160*d*, the interconnecting wires 150*a* may be routed within an area enclosed by the dust covers 155*d*, 156*d* or any other suitable conduit or wire way. Alternatively, conductors associated with the power connections may be located in a raceway or conduit separate from conductors associated with the data connections.

With reference to FIG. 1E, a telescopic seating system 100*e* includes a plurality of foldable chairs 142*e* attached to a telescopic structure 165*e*. As depicted in FIG. 1E, the telescopic seating system 100*e* is expanded and ready for occupants to set in the foldable chairs 142*e*. Each chair may be pivotally attached to the telescopic structure 165*e* via pivot members 166*e*. Any given foldable chair 110*e*, or each of the plurality of foldable chairs 142*e*, may include a work tray 170*e*. The telescopic seating system 100*e* may also include first power connector 146*e* and a first data connector 147*e* mounted to a first dust cover 155*e*. The telescopic seating system 100*e* may also include second power connector 148*e* and a second data connector 149*e* mounted to a second dust cover 156*e*. The first power connector 146*e* and the first data connector 147*e* may be centrally located between a first foldable chair 141*e* and a second foldable chair 142*e*. Alternatively, or additionally, as depicted in FIG. 1E, the power connectors 146*e*, 148*e* and/or data connectors 147*e*, 149*e* may be located on a top dust cover and/or on a deck plate, or any other suitable location within the associated telescopic seating structure.

Figure 1F:
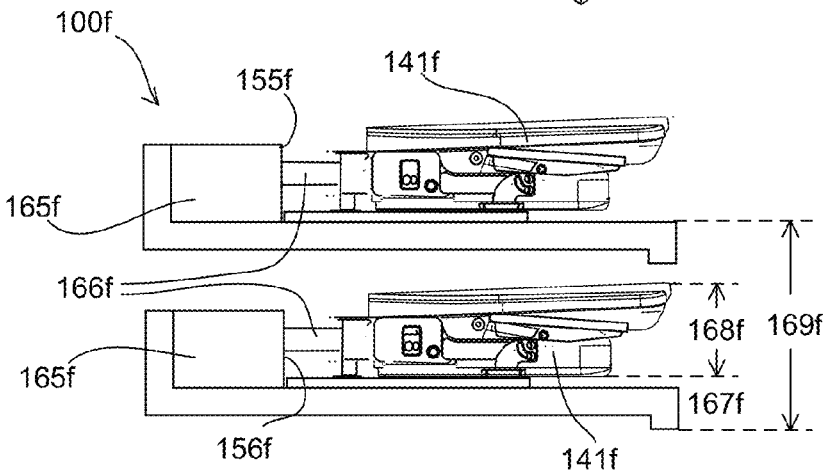
FIG. 1F depicts a perspective view of the example telescopic seating system of FIG. 1E stowed away.

Turning to FIG. 1F, the telescopic seating system 100*e* of FIG. 1E is depicted as a collapsed (or stowed-away) telescopic seating system 100*f*. As can be seen from FIG. 1F, each foldable chair 141*f* is folded-up into a chair distance 168*f*. Each foldable chair 141*f* has pivoted about corresponding pivot members 166*f* relative to the telescopic structure 165*b* when compared to the telescopic seating structure 100*e* of FIG. 1E. As can be seen in FIG. 1F, the telescopic structure 165*f* associated with each foldable chair 141*f* extends a distance 167*f* from the foldable chair 141*f*. The foldable chair 141*f* plus the associated telescopic structure 165*f* is contained within the stowed distance 169*b*. As described in detail herein, chair occupant support structures (e.g., chair occupant support 220, 230 of FIG. 2) may be configured to extend substantially all of the chair distance 168*f*. The telescopic seating system 100*f* may further include a first dust cover 155*f* and a second dust cover 156*f*.

Figure 2:
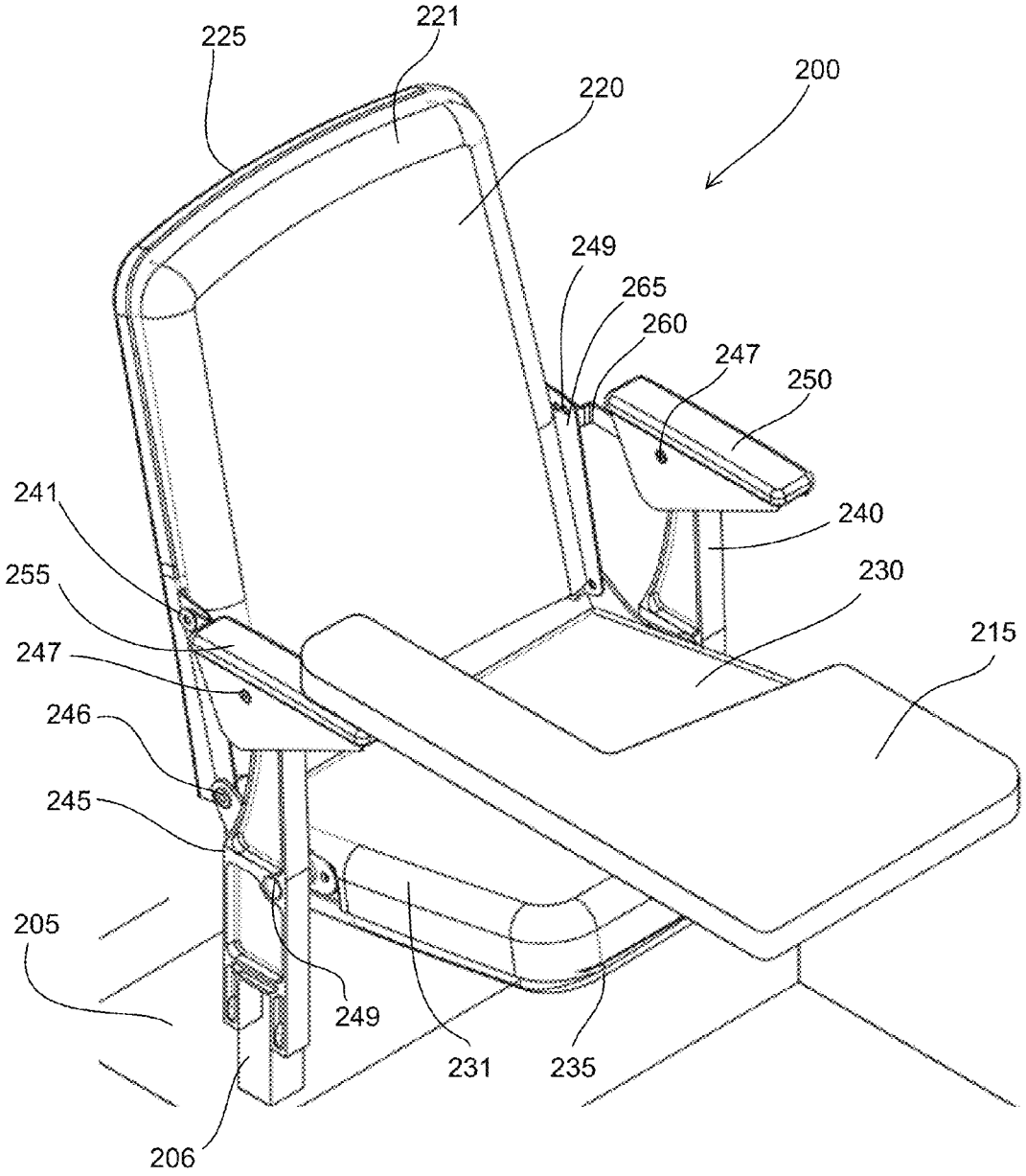
FIG. 2 depicts a perspective view of an example foldable chair, for use within a telescopic seating system of FIGS. 1E and 1F, having a work tray and extended for use.

Turning to FIG. 2, a foldable chair 200, similar to any one of the plurality of foldable chairs 100*e*, 100*f* of FIGS. 1E and 1F, respectively, may be pivotally attached to a telescopic structure 205 via pivot members 206. As depicted in FIG. 2, the foldable chair 200 is unfolded and ready for an occupant to set in the foldable chair 200. For example, a first chair standard 240 may be pivotally attached to the telescopic structure 205 via a first pivot member (not shown in FIG. 2) and a second chair standard 245 may be pivotally attached to the telescopic structure 205 via a second pivot member 206. The foldable chair 200 may further include a back occupant support 220 and a bottom occupant support 230. The back occupant support 220 may include a back cover 221, such as leather, fabric, plastic, vinyl, rubber, composite material, etc., and a back pan 225, such as plastic, wood veneer, vinyl, composite material. In any event, the back cover 221 may be conformed around the back occupant support 220 and, at least partially, held in place via the back pan 225. Similarly, the bottom occupant support 230 may include a bottom cover 231 and a bottom pan 235.

The back occupant support 220 and the bottom occupant support 230 may be pivotally attached to one another via a first seat pivot (not shown in FIG. 2) and a second seat pivot 246. The bottom occupant support 230 may be pivotally attached to the first chair standard 240 via a first bottom pivot (not shown in FIG. 2) and pivotally attached to the second chair standard 245 via a second bottom pivot 249. The back occupant support 220 may be pivotally attached to the first chair standard 240 via a first back bracket 265, a first back pivot 248, a first arm bracket 260 and a first arm pivot 247. The back occupant support 220 may be pivotally attached to the second chair standard 245 via a second back bracket (not shown in FIG. 2), a second back pivot 241, a second arm bracket (not shown in FIG. 2) and a second arm pivot 242. The foldable chair 200 may further include a first arm 250, a second arm 255 and a work tray 215. The foldable chair 200 may be stowed away as illustrated with foldable chair 110*f* of FIG. 1F.

Figure 3A:
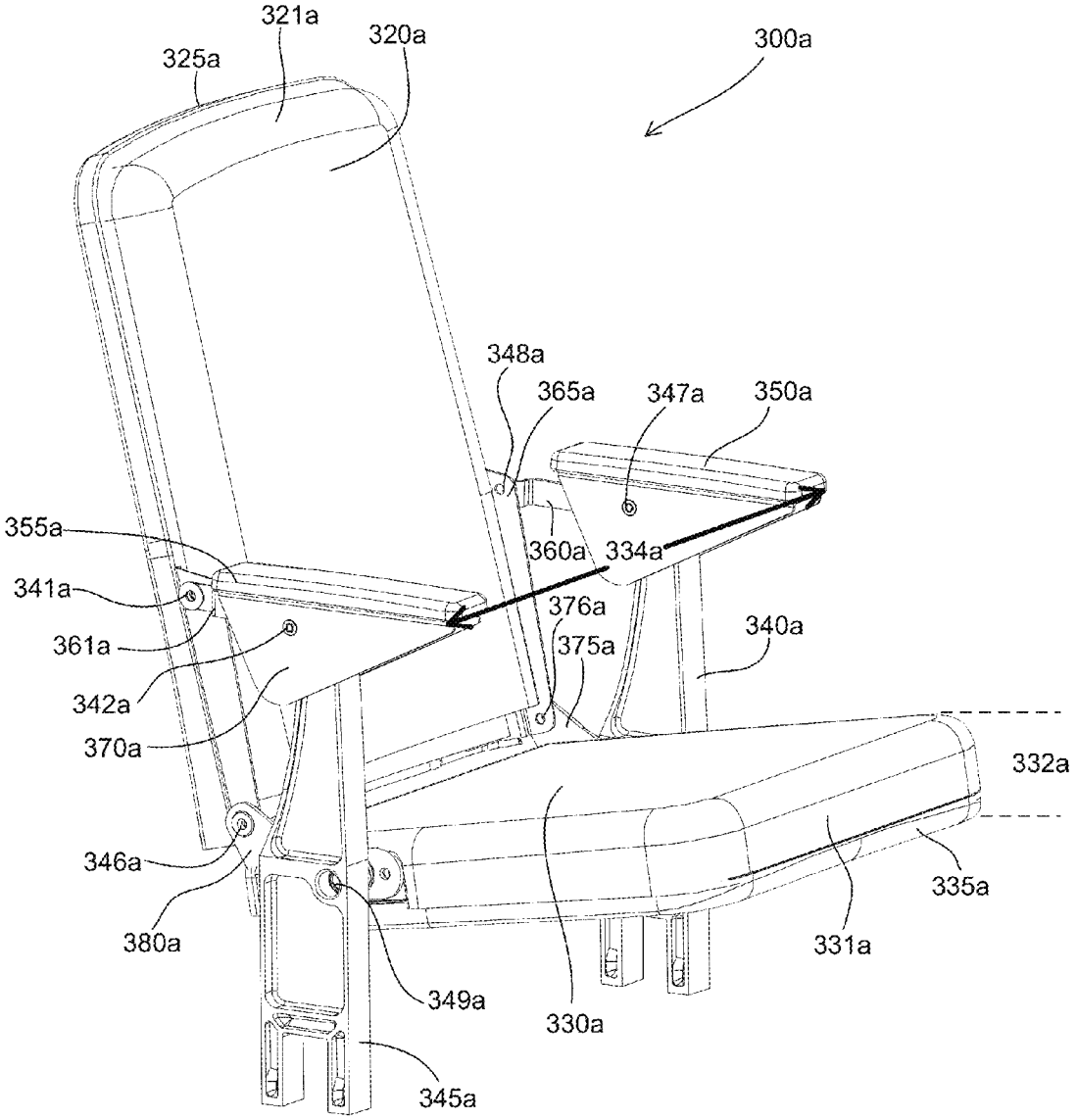
FIGS. 3A-3C depict various views of another example foldable chair for use within a telescopic seating system of FIGS. 1E and 1F.
Figure 3B:
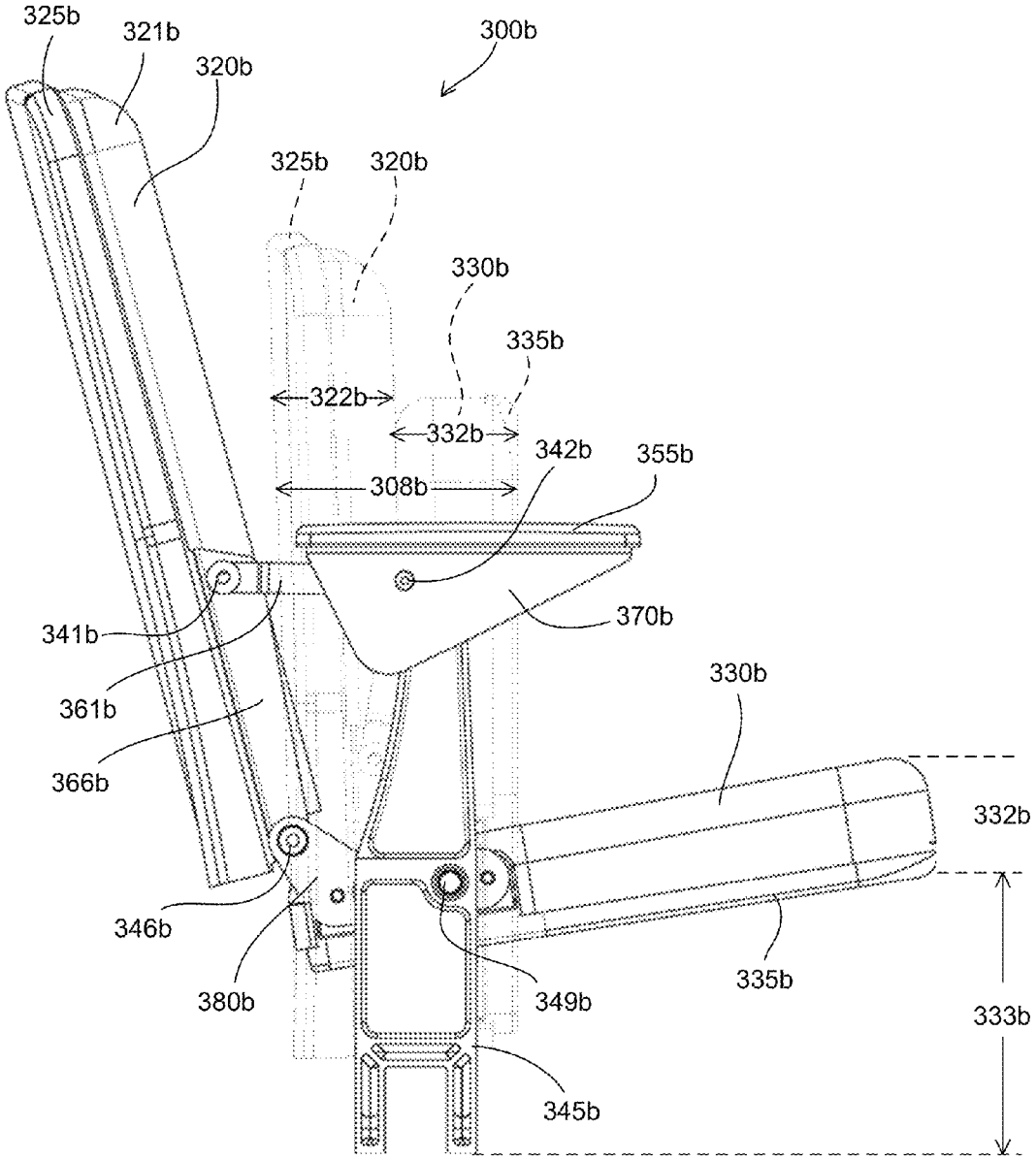
Figure 3C:
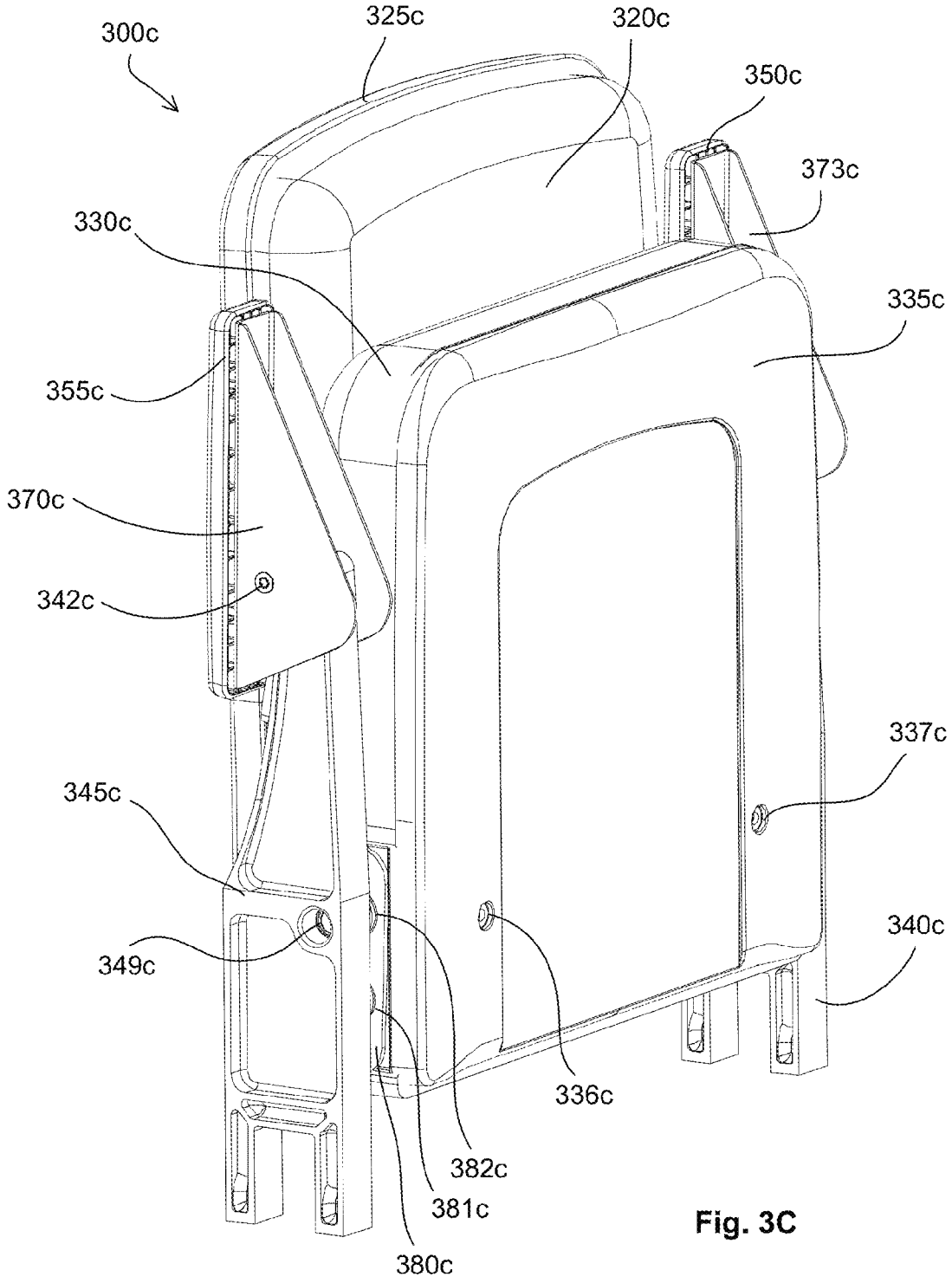

Turning to FIGS. 3A-3C, a foldable chair 300*a*, 300*b*, 300*c* is depicted that is similar to foldable chairs 142*e*, 141*f*, 200*a* aside from the foldable chair 300*a*, 300*b*, 300*c* not having a work tray 170*e*, 170*f*, 215. The foldable chair 300*a* is unfolded and ready for an occupant to set in the foldable chair 300*a*. The foldable chair 300*c* is folded and ready to be stowed away. The foldable chair 300*b* illustrates the foldable chair 300*c* superimposed in relation to the foldable chair 300*a*. The foldable chair 300*a*, 300*b*, 300*c* may include a back occupant support 320*a*, 320*b*, 320*c* and a bottom occupant support 330*a*, 330*b*, 330*c*. The back occupant support 320*a*, 320*b*, 320*c* may include a back cover 321*a*, 321*b*, 321*c*, such as leather, fabric, plastic, vinyl, rubber, composite material, etc., and a back pan 325*a*, 325*b*, 325*c*, such as plastic, wood veneer, vinyl, composite material. In any event, the back cover 321*a*, 321*b*, 321*c* may be conformed around the back occupant support 320*a*, 320*b*, 320*c* and, at least partially, held in place via the back pan 325*a*, 325*b*, 325*c*. Similarly, the bottom occupant support 330*a*, 330*b*, 330*c* may include a bottom cover 331*a*, 331*b*, 331*c* and a bottom pan 335*a*, 335*b*, 335*c*.

The back occupant support 320*a*, 320*b*, 320*c* and the bottom occupant support 330*a*, 330*b*, 330*c* may be pivotally attached to one another via a first seat pivot 376*a*, incorporated into a first bottom chair bracket 375*a*, and a second seat pivot 346*a*, 346*b* incorporated into a second bottom chair bracket 380*a*, 380*b*, 380*c*. As can be seen in FIG. 3C, the second bottom chair bracket 380*c* may include a first post 382*c* and a second post 381*c*. The first post 382*c* may cooperate with the second bottom pivot 349*a*, 349*b*, 349*c* to pivotally attach the bottom occupant support 330*a*, 330*b*, 330*c* to the second chair standard 345*a*, 345*b*, 345*c*.

The bottom occupant support 330*a*, 330*b*, 330*c* may be pivotally attached to the first chair standard 340*a*, 340*c* via a first bottom pivot (not shown in FIGS. 3A-3B) and pivotally attached to the second chair standard 345*a*, 345*b*, 345*c* via a second bottom pivot 349*a*, 349*b*, 349*c*. The back occupant support 320*a*, 320*b*, 320*c* may be pivotally attached to the first chair standard 340*a*, 340*c* via a first back bracket 365*a*, a first back pivot 348*a*, a first arm bracket 360*a* and a first arm pivot 347*a*. The back occupant support 320*a*, 320*b*, 320*c* may be pivotally attached to the second chair standard 345*a*, 345*b*, 345*c* via a second back bracket 380*a*, 380*b*, 380*c*, a second back pivot 341*a*, 341*b*, a second arm bracket 361*a*, 361*b* and a second arm pivot 342*a*, 342*b*, 342*c*. The foldable chair 300*a*, 300*b*, 300*c* may further include a first arm 350*a*, 350*c* and a second arm 355*a*, 355*b*, 355*c*. As depicted in FIG. 3C, the bottom pan 335*a*, 335*b*, 335*c* may be attached to the bottom occupant support 330*a*, 330*b*, 330*c* via a first fastener 336*c* and a second fastener 337*c*.

The foldable chair 300*a*, 300*b*, 300*c* may be stowed away as illustrated with foldable chair 141*f* of FIG. 1F. As depicted in FIGS. 3A-3C, the bottom occupant support 330*a*, 330*b*, 330*c* and bottom pan 335*a*, 335*b*, 335*c* may have a thickness 332*a*, 332*b*, 332*c*. As depicted in FIG. 3B, the back occupant support 320*b* and back pan 325*b* may have a thickness 322*b*. As further depicted in FIG. 3B, the back occupant support 320*b* and back pan 325*b* combined with the bottom occupant support 330*b* and bottom pan 335*b* may have a thickness 308*b*. As yet further depicted in FIG. 3B, the foldable chair 300*b* may have a distance 333*b* extending vertically from a bottom of the first chair standard 345*b* to the bottom pan 335*b*.

Figure 4A:
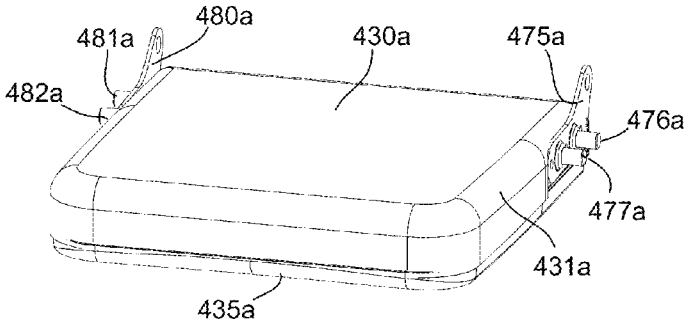
FIGS. 4A-4E depict various views of an example chair occupant support.
Figure 4B:
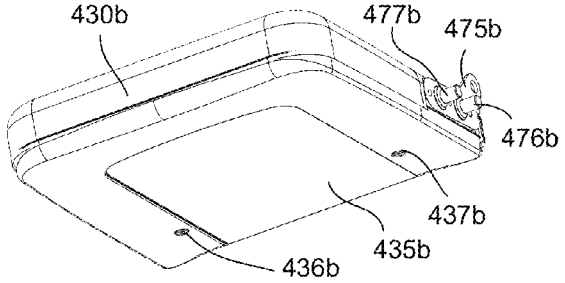
Figure 4C:
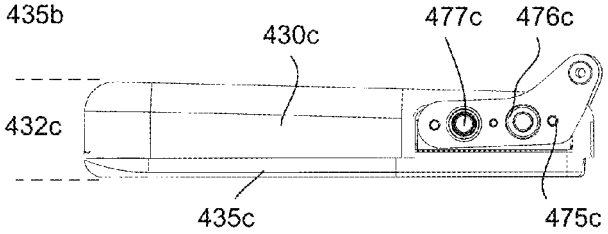
Figure 4D:
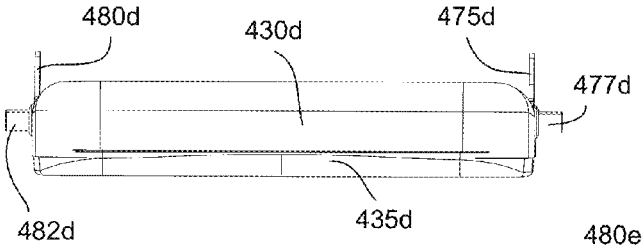
Figure 4E:
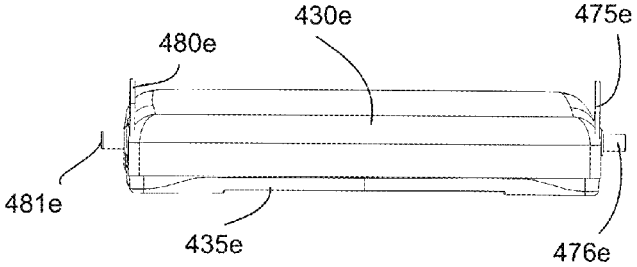

With reference now to FIGS. 4A-4E an bottom occupant support 430*a*-430*e* may include a bottom cover 431*a* and a bottom pan 435*a*-435*e*. The bottom occupant support 430*a*-430*e* may be similar to bottom occupant support 230, 330*a*-330*c* of FIGS. 2 and 3A-3C, respectively. FIG. 4A depicts a top perspective view of the bottom occupant support 430*a*. FIG. 4B depicts a bottom perspective view of the bottom occupant support 430*b*. FIG. 4C depicts a left side profile view of the bottom occupant support 430*c*. FIG. 4D depicts a front profile view of the bottom occupant support 430*d*. FIG. 4D depicts a back profile view of the bottom occupant support 430*d*.

The bottom occupant support 430*a*-430*e* may further include a first bottom bracket 475*a*-475*e* and a second bottom bracket 480*a*, 480*d*, 480*e*. The first bottom bracket 475*a*-475*e* may include a first post 476*a*, 476*b*, 476*c*, 476*e* and a second post 477*a*-477*d*. The second bottom bracket 480*a*, 480*d*, 480*e* may include a first post 481*a*, 481*e* and a second post 482*a*, 482*d*. As further shown in FIG. 4C, the bottom occupant support 430*a*-430*e* combined with the bottom pan 435*a*-435*e* may have a thickness 432*c*. It should be understood that a back occupant support 220, 320*a*-320*c* of FIGS. 2 and 3A-C, respectively, may contain similar features as bottom occupant support 430*a*-430*e*.

Figure 5A:
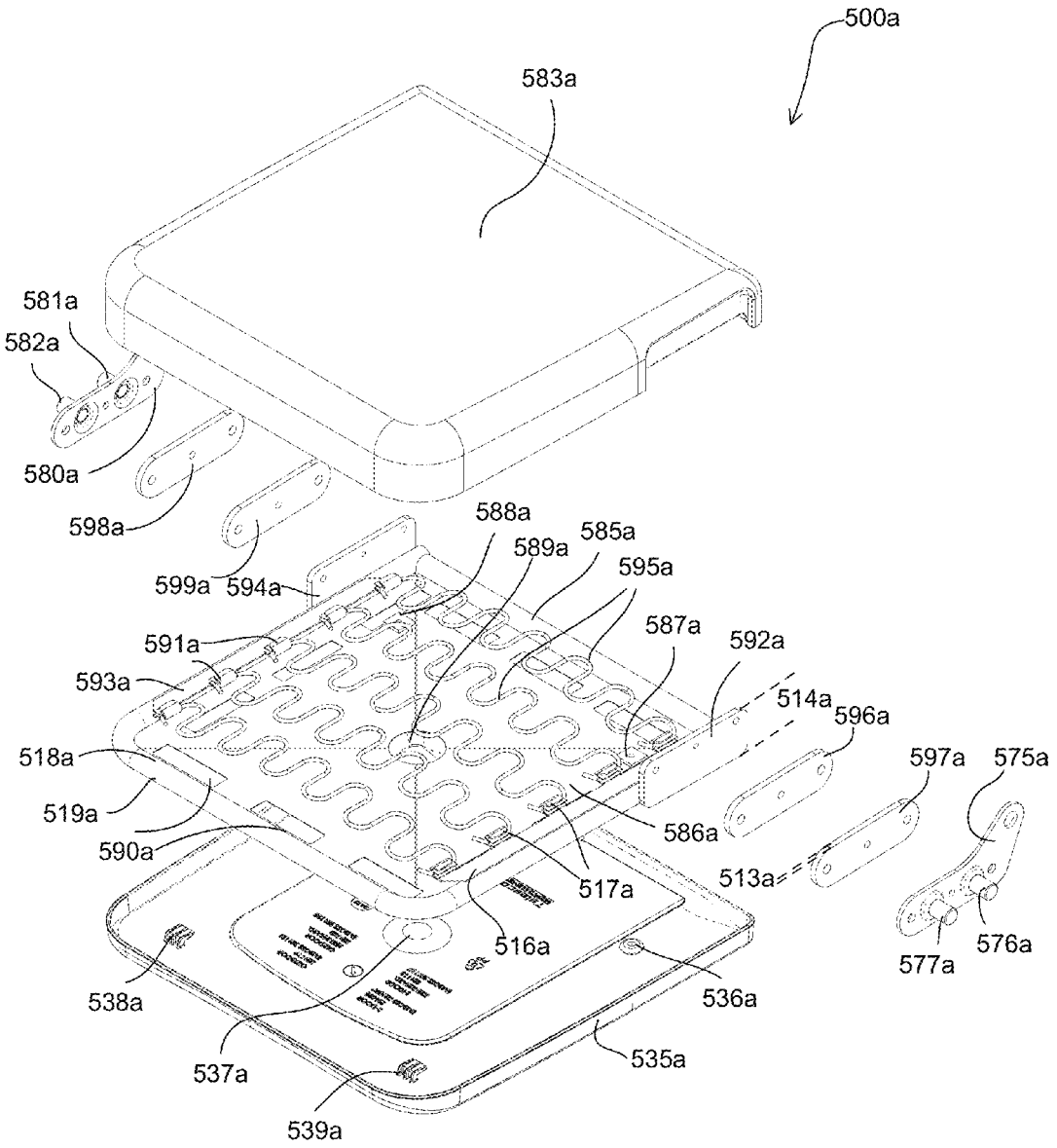
FIG. 5A depicts an exploded, perspective view, of an example chair occupant support similar to FIGS. 4A-4E.

Turning to FIG. 5A, an exploded, top perspective view of a bottom occupant support 500*a* is depicted. The bottom occupant support 500*a* may be similar to bottom occupant support 430*a*-430*e* of FIGS. 4A-4E. The back occupant support 220, 320*a*-320*c* of FIGS. 2 and 3A-3C may include similar features as will be described with regard to bottom occupant support 500*a*. The bottom occupant support 500*a* may include a bottom cushion 583*a*, a bottom frame structure 585*a* and a bottom pan 535*a*. The bottom occupant support 500*a* may further include a bottom cover (not shown in FIG. 5A) that may wrap around the bottom cushion 583 and around the sides of the bottom frame structure 585*a* an secure to the rectangular openings 590*a*. The bottom pan 535*a* may be secured to the bottom frame structure 585*a* via a first hook 538*a* engaging an edge of a first rectangular opening 590*a*, a second hook 539*a* engaging an edge of a second rectangular opening 590*a*, a first fastener (not shown in FIG. 5A) extending through a first hole 536*a* to engage a first connector 587*a* and a second fastener (not shown in FIG. 5A) extending through a second hole (not shown in FIG. 5A) to engage a second connector 588. Thereby, the bottom pan 535*a* provides a decorative, aesthetically pleasing, cover over the edges of the bottom cover.

With further reference to FIG. 5A, the bottom pan 535*a* may include a mold plug 537*a* that aligns with, and is received in, an opening 589*a* in a membrane 586*a* of the bottom frame structure 585*a*. The bottom frame structure 585*a* may further include a first spring attachment 516*a* and a second spring attachment 593*a*. The first and second spring attachments 516*a*, 593*a* may be secured to the bottom frame structure 585*a* anywhere between a top surface 518*a* of the bottom frame structure 585*a* and a bottom surface 519*a* of the bottom frame structure 585*a*. In any event, the first and second spring attachments 516*a*, 593*a* may include spring hooks 517*a*, 591*a*, respectively, to secure a series of support springs 595*a* to the first and second spring attachments 516*a*, 593*a*. While the support springs 595*a* may bow away from the membrane 586*a* when there is no occupant setting on the bottom occupant support 500*a*, the support springs 595*a* may bow toward the membrane 586*a*, and extend into a space defined by the top surface 518*a* and the bottom surface 519*a* of the bottom frame structure 585*a*, when an occupant sets on the bottom occupant support 500*a*. The bottom cushion 583*a* may conform to the support springs 595*a* to provide additional comfort to the occupant. While the support springs 595*a* are depicted as extending from side-to-side across the occupant support 500*a*, the support springs 595*a* may extend from front-to-back and/or both side-to-side and front-to-back. The occupant support 500*a* may include support springs 595*a* closer together in some sections compared to other sections, thereby, the support springs may further conform to at least a portion of a profile of an occupant. The occupant support 500*a* may be configured such that the support springs 595*a* are compressed against the membrane 586*a* when an occupant weighing over 200 lbs. sets on the occupant support 500*a*. Alternatively, or additionally, the support springs 595*a* may deflect only to the upper surface 518*a* of the structural frame 585*a* when an occupant weighing less than 50 lbs. sets on the occupant support 500*a*.

The bottom occupant support 500*a* may further include a first bottom bracket 575*a* and a second bottom bracket 580*a*. The first bottom bracket 575 may include a first post 576 and a second post 577*a*. The second bottom bracket 580 may include a first post 581*a* and a second post 582*a*. The bottom occupant support 500*a* may also include a first plate 596*a* and a second plate 597*a* that space the first bottom bracket 575*a* from the first frame bracket 592*a* when the first bottom bracket 575*a* is connected to the first frame bracket 592*a*. The bottom occupant support 500*a* may also include a third plate 598*a* and a fourth plate 599*a* that space the second bottom bracket 580*a* from the second frame bracket 594*a* when the second bottom bracket 580*a* is connected to the second frame bracket 594*a*. The first frame bracket 592*a*, the first plate 596*a*, the second plate and the first bottom bracket 575*a* along with the second frame bracket 594*a*, the third plate 598*a*, the fourth plate 599*a* and the second bottom bracket 580*a* may be used to vary an overall width (e.g., distance 334*a* of FIG. 3A) and a height (e.g. distance 333*b* of FIG. 3B), with respect to a bottom of a chair standard (e.g., chair standard 345*b* of FIG. 3B), of the a foldable chair 142*e*, 141*f*, 200, 300*a*-300*c*. The first frame bracket 592*a*, the first plate 596*a*, the second plate along with the second frame bracket 594*a*, the third plate 598*a*, the fourth plate 599*a* may be covered by a portion of the cushion (e.g., portion 681*a*, 681*b* of FIGS. 6A and 6B, respectively) and a corresponding seat cover to substantially hide the first frame bracket 592*a*, the first plate 596*a*, the second plate along with the second frame bracket 594*a*, the third plate 598*a*, the fourth plate 599*a* from view.

For example, a height 514*a* of the first frame bracket 592*a* and a corresponding height of the second frame bracket 594*a* may be varied to change the distance 333*b*. Thereby, a height (e.g., distance 332*b* plus distance 333*b* of FIG. 3B) of a top surface of the bottom occupant support 500*a* may be kept constant irrespective of the thickness (e.g., distance 332*b* of FIG. 3B) of the bottom occupant support 500*a*. As a result, a thicker (e.g., distance 685*a* of FIG. 6A) cushion 585*a* may be incorporated within a bottom occupant support 500*a* and not change the height (e.g., distance 332*b* plus distance 333*b* of FIG. 3B). A thickness 513*a* of the second plate 597*a* along with a corresponding thickness of the first plate 596*a*, the third plate 598*a* and the fourth plate 599*a* may be varied, or a plate 596*a* and/or 597*a* and 598*a* and/or 599*a* may be removed, to change the distance 334*a*. Thereby, wider and narrower bottom occupant supports 500*a* may be accommodated.

While not shown in FIG. 5A, the bottom occupant support 500*a* may in fabric sheets (or "scrim") place between the cushion 583*a* and the support springs 595*a* and/or between the support springs 595*a* and the membrane 586*a*. The fabric sheets (or "scrim") may reduce noise and wear. The fabric sheets may be referred to as an anti-chafe barrier.

Figure 5B:
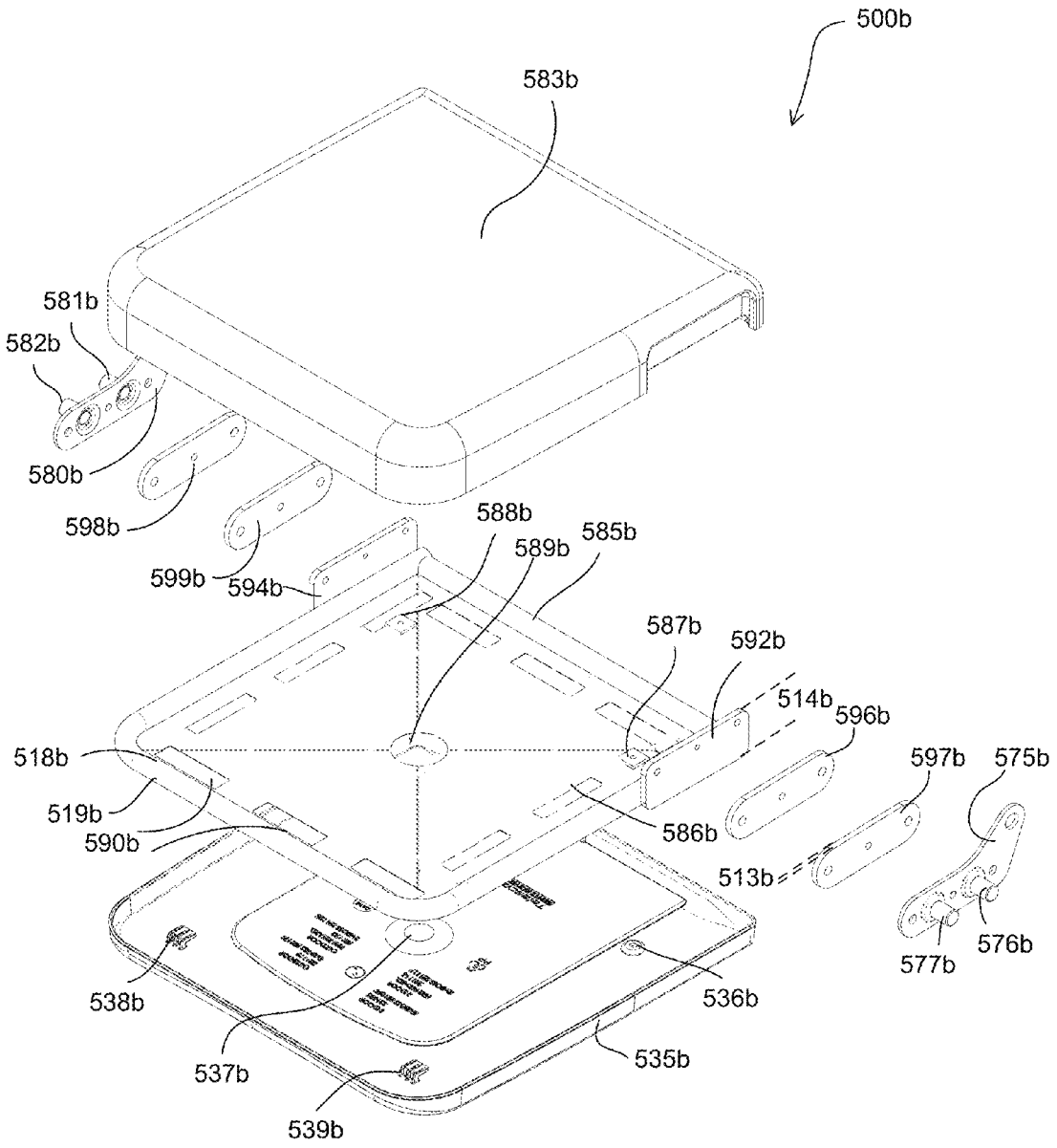
FIG. 5B depicts an exploded, perspective view, of another example chair occupant support similar to FIGS. 4A-4E.

With referenced to FIG. 5B, a bottom occupant support 500*b* may similar to the bottom occupant support 500*a* of FIG. 5A except the bottom occupant support 500*b* does not include the first and second spring attachments 516*a*, 593*a*, the spring hooks 517*a*, 591*a*, respectively, to secure a series of support springs 595*a* to the first and second spring attachments 516*a*, 593*a*. Indeed, the cushion 583*b* is configured to be directly supported by the membrane 586*b* with no intervening support springs 595*a*. The cushion 583*b* may substantially completely fill a space define to be between a top surface 518*b* and a bottom surface 519*b* of the frame structure 585*b*. The remaining reference numbers of FIG. 5B are intended to represent the same elements as with respect to the reference numbers of FIG. 5A only followed by a "b" in lieu of an "a."

Figure 6A:
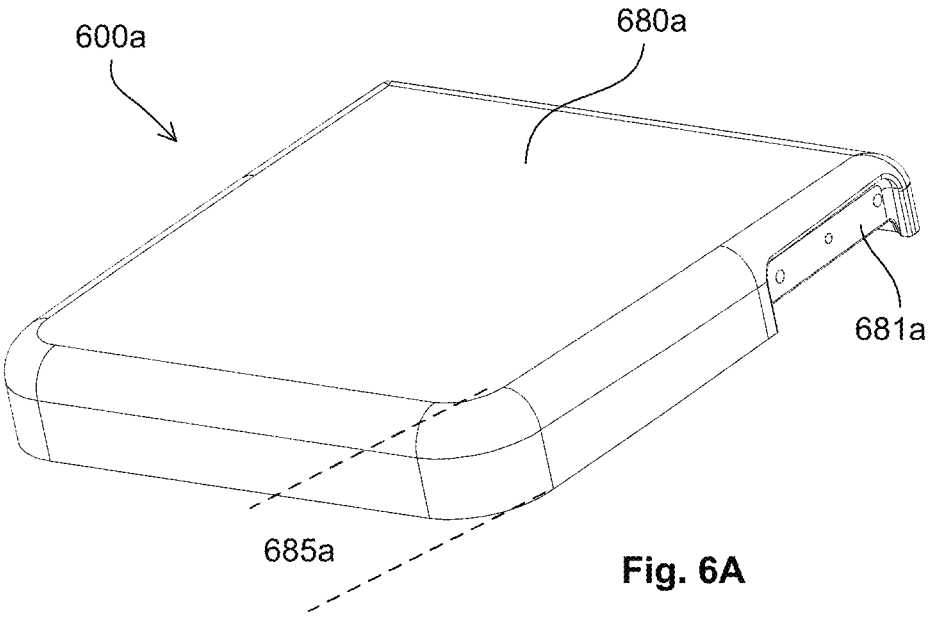
FIGS. 6A and 6B depict perspective views of an example chair cushion.
Figure 6B:
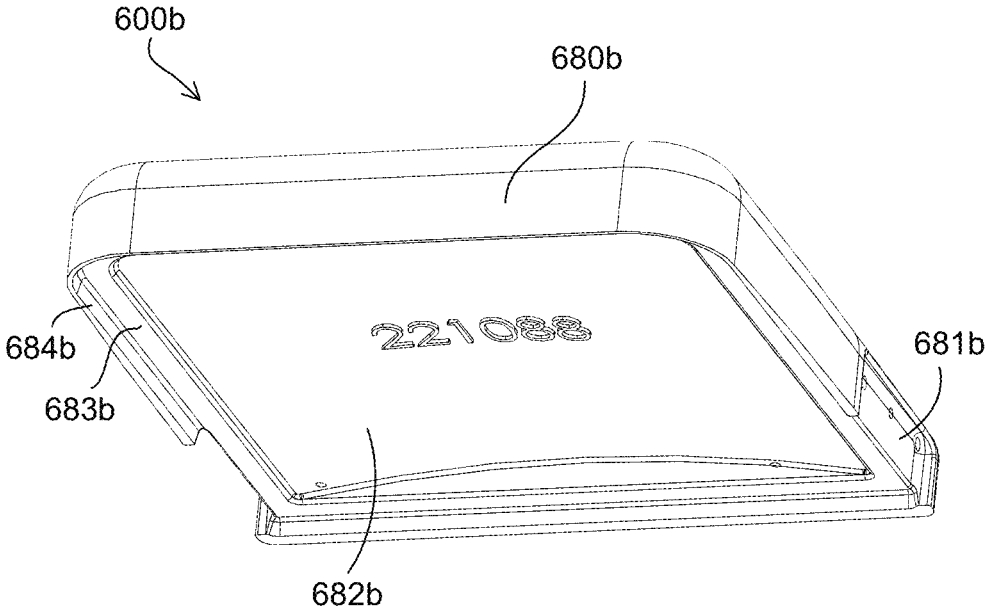

With reference now to FIGS. 6A and 6B, a bottom cushion 600*a*, 600*b* may include a top surface 680*a*, a perimeter surface 680*b* with a bottom frame bracket receptacle 681*a*, 681*b*, and a bottom surface 682*b*. The bottom cushion 583*a*, 583*b* of FIGS. 5A and 5B, respectively, may be similar to the bottom cushion 600*a*, 600*b*. The bottom cushion 600*a*, 600*b* may include a thickness 685*a*. A channel 683*b* and a lip 684*b* may define a frame receptacle to receive a bottom frame structure (e.g., bottom frame structure 585*a* of FIG. 5A). The bottom cushion 600*a*, 600*b* may be made of foam rubber, air (or gas) infused plastic, Styrofoam, sponge rubber, sponge, feather filled pack, etc. A back cushion may be similar in construction to the bottom cushion 600*a*, 600*b*. The cushion 600*a*, 600*b* may have a contoured upper surface 680*a* that conforms to at least a portion of a profile of an occupant. Alternatively, or additionally, the cushion 600*a*, 600*b* may have a variable density, such that the cushion 600*a*, 600*b* further conforms to at least a portion of a profile of an occupant.

Figure 6C:
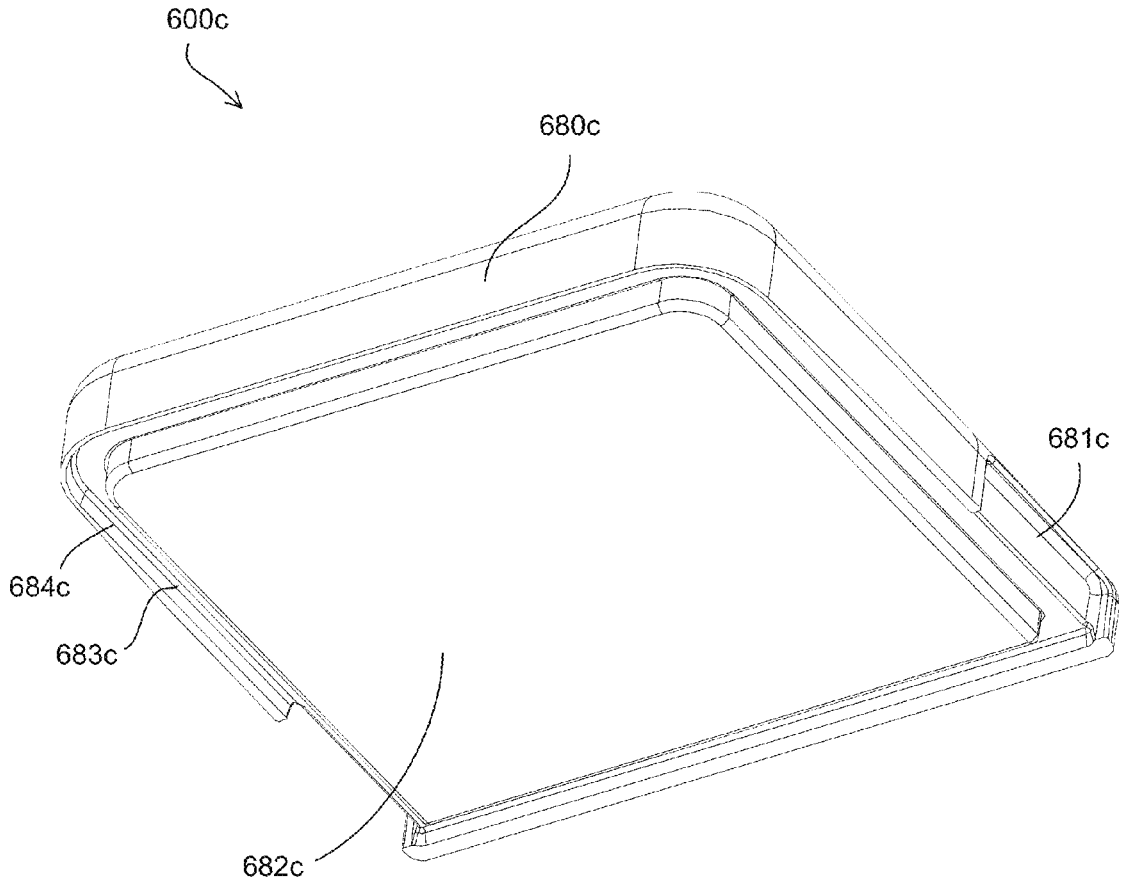
FIG. 6C depicts a perspective view of a bottom of another example chair cushion.

With reference to FIG. 6C, the cushion 600*c* may be similar to the cushion 600*a*, 600*b* except that the cushion 600*c* may include a bottom surface 682*c* that extends into a space below a top surface of a corresponding frame structure (e.g., frame structure 585*b* of FIG. 5B). The bottom surface 682*c* may be in direct contact with a corresponding membrane (e.g., membrane 586*b* of FIG. 5B). The cushion 600*c* may further include a bottom frame bracket receptacle 681*c* and a channel 683*c* and a lip 684*c*.

Figure 7:
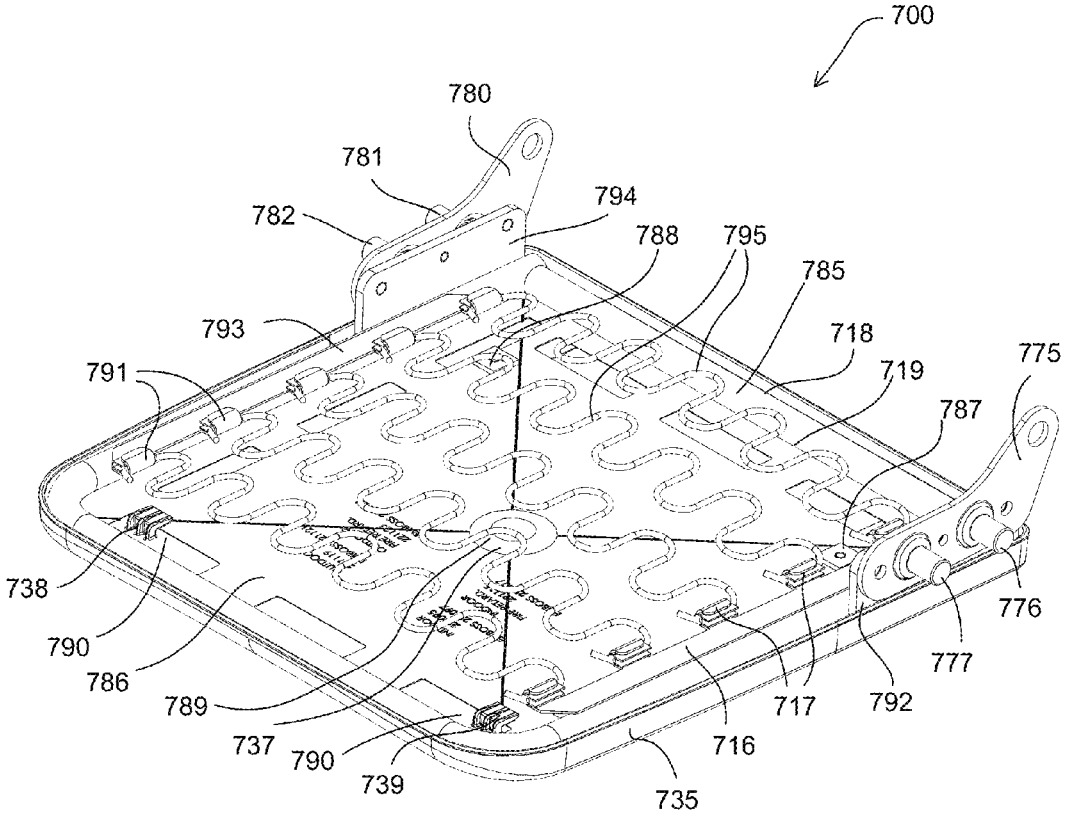
FIG. 7 depicts a perspective view of an example chair support frame structure along with a spring structure and a chair pan for use in a chair occupant support.

Turning to FIG. 7, a top perspective view of a bottom frame structure 785 with support springs 785 is depicted along with a bottom pan 735. The bottom frame structure 785 may be similar to the bottom frame structure 585*a* of FIG. 5A and the bottom pan 735 may be similar to bottom pan 535*a* of FIG. 5A. The bottom pan 735 may be secured to the bottom frame structure 785 via a first hook 738 engaging an edge of a first rectangular opening 790, a second hook 739 engaging an edge of a second rectangular opening 790, a first fastener (not shown in FIG. 7) extending through a first hole (not shown in FIG. 7) to engage a first connector 787 and a second fastener (not shown in FIG. 7) extending through a second hole (not shown in FIG. 7) to engage a second connector 788. The bottom pan 735 may include a mold plug 737 that aligns with, and is received in, an opening 789 in a membrane 786 of the bottom frame structure 785. The bottom frame structure 785 may further include a first spring attachment 716 and a second spring attachment 793. The first and second spring attachments 716, 793 may be secured to the bottom frame structure 785 anywhere between a top surface 718 of the bottom frame structure 785 and a bottom surface 719 of the bottom frame structure 785. In any event, the first and second spring attachments 716, 793 may include spring hooks 717, 791, respectively, to secure a series of support springs 795 to the first and second spring attachments 716, 793. While the support springs 795 may bow away from the membrane 786 when there is no occupant setting on the bottom occupant support (e.g., bottom occupant support 500*a* of FIG. 5A), the support springs 795 may bow toward the membrane 786, and extend into a space defined by the top surface 718 and the bottom surface 719 of the bottom frame structure 785, when an occupant sets on the bottom occupant support 500*a*.

The bottom frame structure 785 may further include a first bottom bracket 775 and a second bottom bracket 780. The first bottom bracket 775 may include a first post 776 and a second post 777. The second bottom bracket 780 may include a first post 781 and a second post 782. The bottom frame structure may also include a first frame bracket 792 and a second frame bracket 794.

Figure 8A:
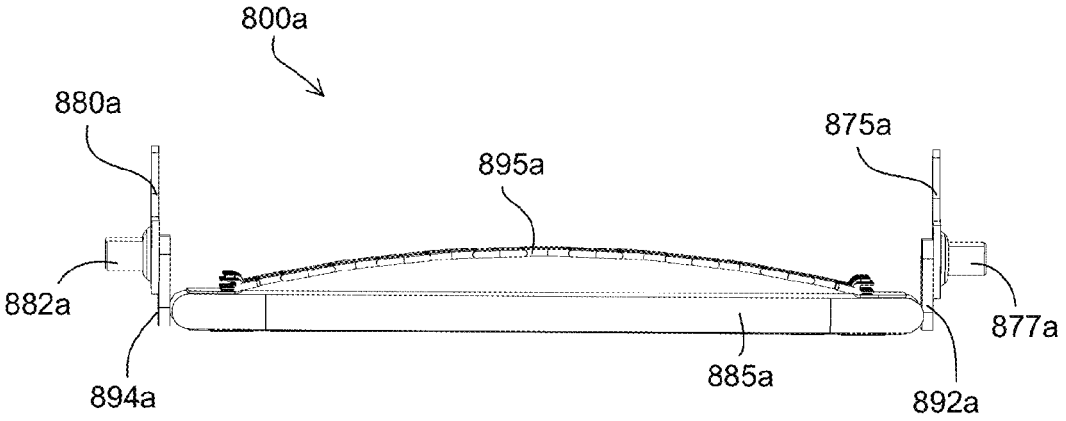
FIGS. 8A-8H and 8J-8N depict various views of components for use in a chair occupant support.

With reference to FIGS. 8A-8H and 8J-8N, further details of a bottom frame structure 800*a-h*, 800*j*-800*n* are depicted. FIG. 8A depicts a front plan view of a bottom frame structure 800*a*. The bottom frame structure 800*a* may include a frame 885*a*, support springs 895*a*, a first frame bracket 892*a*, a second frame bracket 894*a*, a first bottom frame bracket 875*a* and a second bottom frame bracket 880*a*. The first bottom frame bracket 875*a* may include a second post 877*a* and the second bottom frame bracket 880*a* may include a second post 882*a*.

Figure 8B:
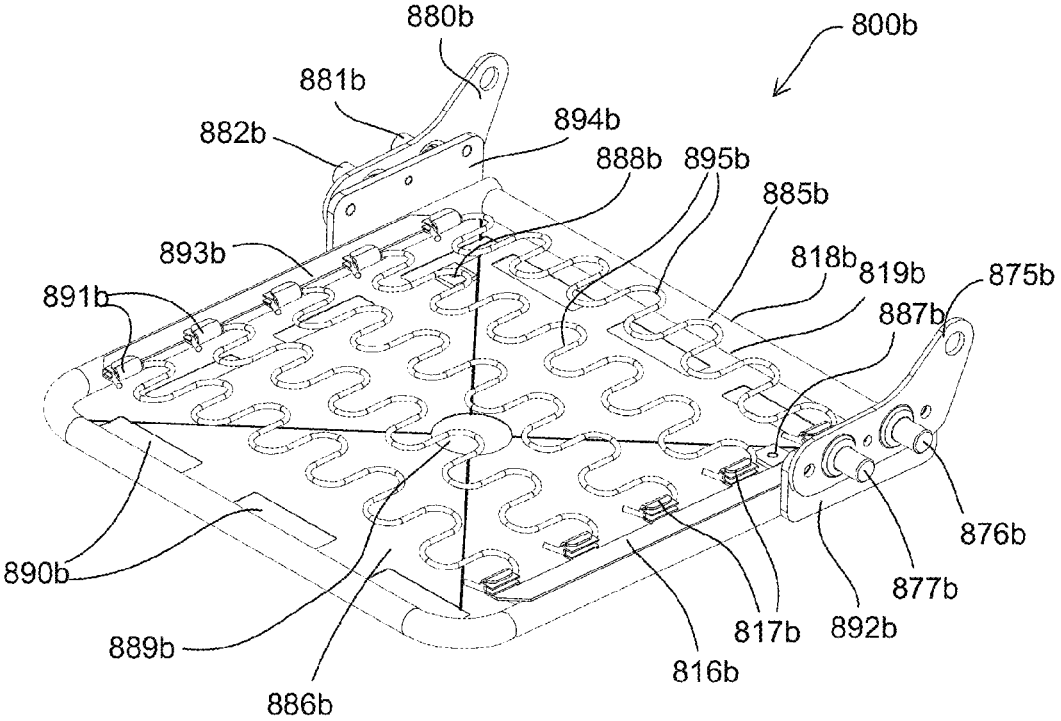
Figure 8C:
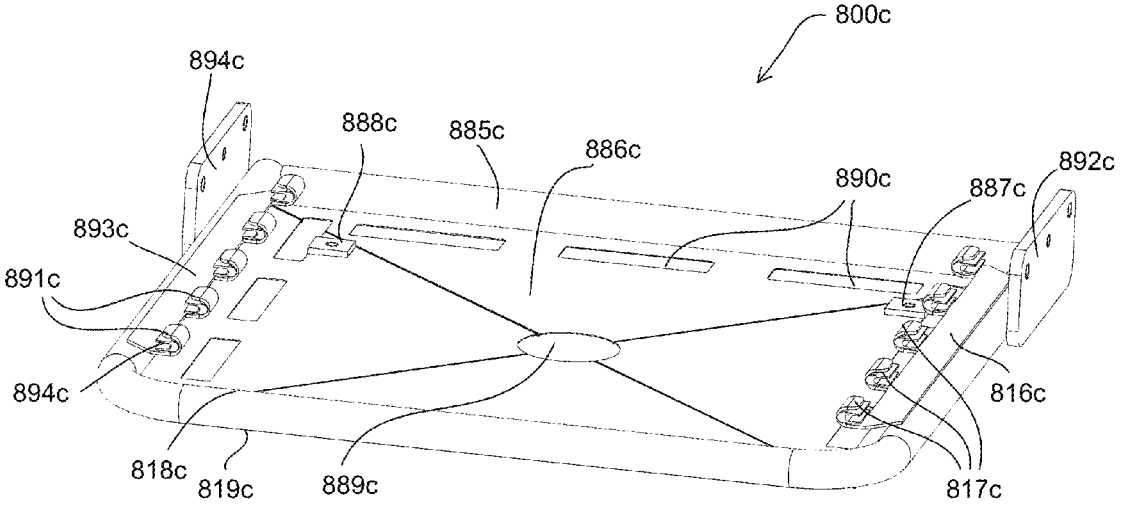
Figure 8D:
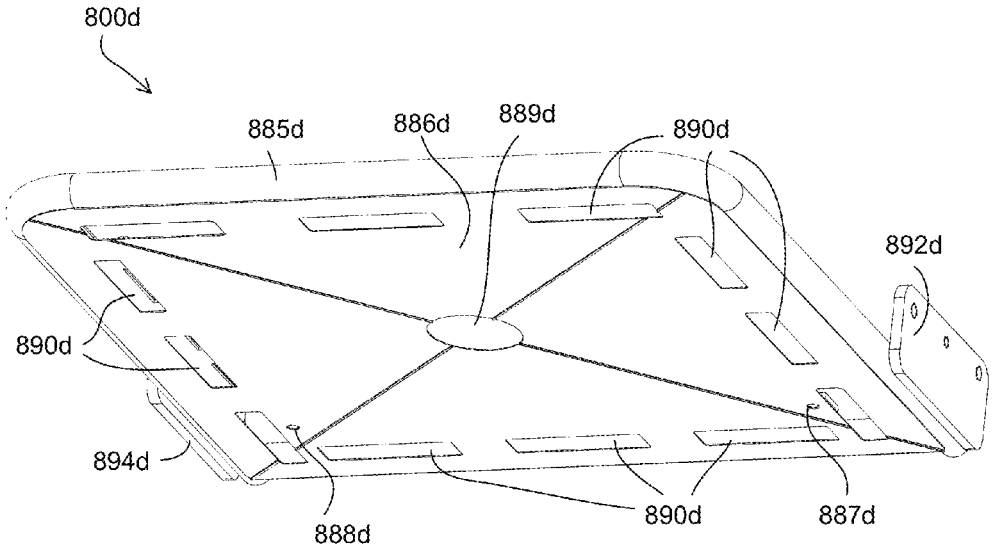
Figure 8E:
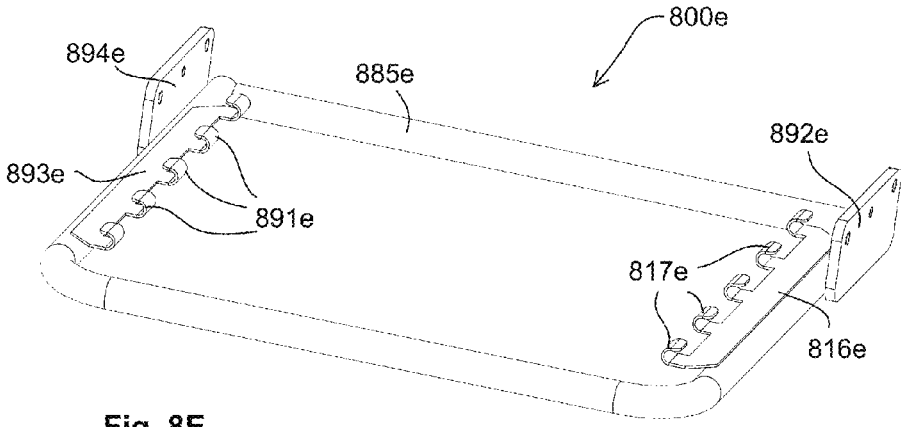
Figure 8F:
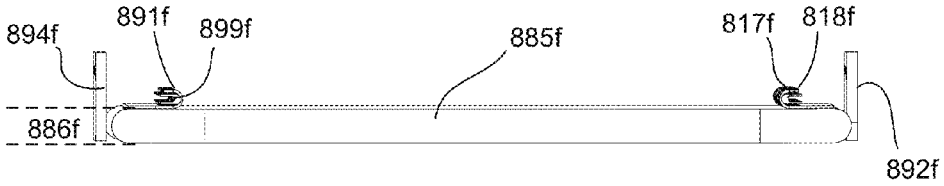
Figure 8G:
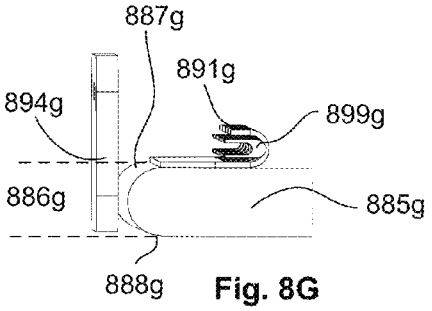
Figure 8H:
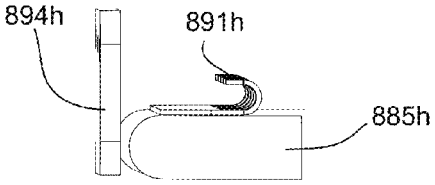
Figure 8J:
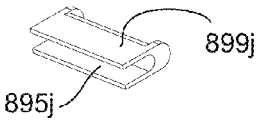
Figure 8K:
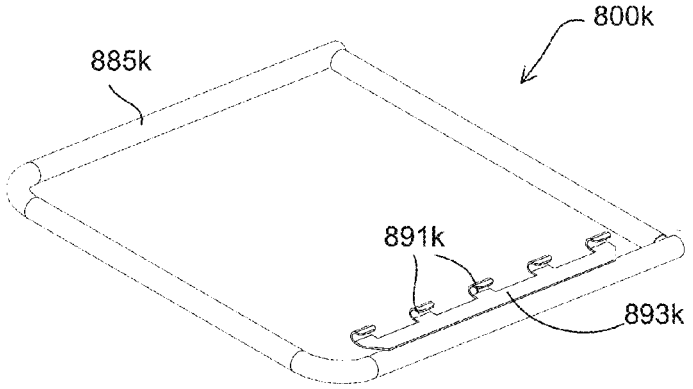
Figure 8L:
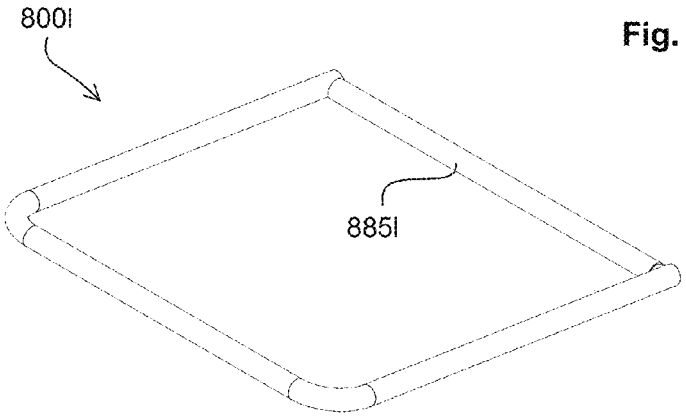
Figure 8M:
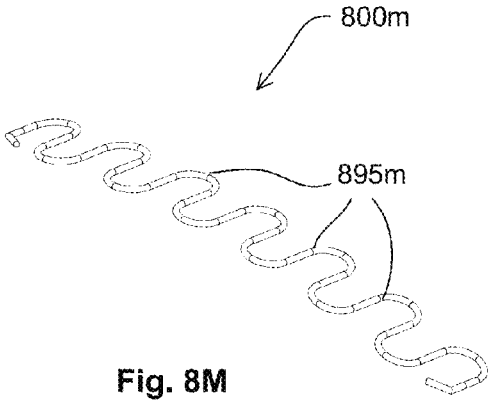
Figure 8N:
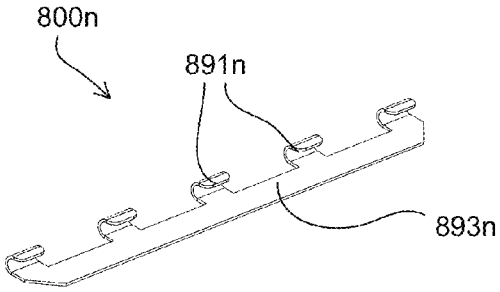

The bottom frame structure 800*a-h*, 800*j*-800*n* may be similar to the bottom frame structure 585*a* of FIG. 5A. The bottom frame structure 800*b* may include a plurality of rectangular openings 890*b* in a membrane 886*b*. While the openings 890*b* are shown in FIG. 8B as being rectangular in shape, it should be understood that the openings 890*b* may define any shape, such as circular, square, triangle, oval, etc. The membrane 886*b* may include an opening 889*b*. The bottom frame structure 885*b* may further include a first spring attachment 816*b* and a second spring attachment 893*b*. The first and second spring attachments 816*b*, 893*b* may be secured to the bottom frame structure 885*b* anywhere between a top surface 818*b* of the bottom frame structure 885*b* and a bottom surface 819*b* of the bottom frame structure 885*b*. In any event, the first and second spring attachments 816*b*, 893*b* may include spring hooks 817*b*, 891*b*, respectively, to secure a series of support springs 895*b* to the first and second spring attachments 816*b*, 893*b*. While the support springs 895*b* may bow away from the membrane 886*b* when there is no occupant setting on the bottom occupant support (e.g., bottom occupant support 500*a* of FIG. 5A), the support springs 895*b* may bow toward the membrane 886*b*, and extend into a space defined by the top surface 818*b* and the bottom surface 819*b* of the bottom frame structure 885*b*, when an occupant sets on the bottom occupant support 500*a*. The support springs 895*b* may be substantially flat across the spring attachment 816*b* to the spring attachment 893*b* when there is no occupant setting on the bottom occupant support 500*a*. Alternatively, the support springs 895*b* may bow toward the membrane 886*b* when there is no occupant setting on the bottom occupant support 500*a*.

The bottom frame structure 885*b* may further include a first bottom bracket 875*b* and a second bottom bracket 880*b*. The first bottom bracket 875*b* may include a first post 876*b* and a second post 877*b*. The second bottom bracket 880*b* may include a first post 881*b* and a second post 882*b*. The bottom frame structure may also include a first frame bracket 892*b* and a second frame bracket 894*b*.

The bottom frame structure 800*c*, 800*d* may include a plurality of rectangular openings 890*c*, 890*d* in a membrane 886*c*, 886*d*. The membrane 886*c*, 886*d* may include an opening 889*c*, 889*d*. The bottom frame structure 885*c*, 885*d* may further include a first spring attachment 816*c* and a second spring attachment 893*c*. The first and second spring attachments 816*c*, 893*c* may be secured to the bottom frame structure 885*c* anywhere between a top surface 818*c* of the bottom frame structure 885*c* and a bottom surface 819*c* of the bottom frame structure 885*c*. In any event, the first and second spring attachments 816*c*, 893*c* may include spring hooks 817*c*, 891*c*. The bottom frame structure 800*c*, 800*d* may also include a first frame bracket 892*c*, 892*d* and a second frame bracket 894*c*, 894*d*. The membrane 886*c*, 886*d* may further include a first connector 887*c*, 887*d* and a second connector 888*c*, 888*d*.

The bottom frame structure 800*e* may include a frame 885*e*, a first spring attachment 816*e* having a plurality of spring hooks 817*e*, a second spring attachment 893*e* having a plurality of spring hooks 891*e*, a first frame bracket 892*e* and a second frame bracket 894*e*. The frame 885*e*, the first spring attachment 816*e* having a plurality of spring hooks 817*e*, the second spring attachment 893*e* having a plurality of spring hooks 891*e*, the first frame bracket 892*e* and the second frame bracket 894*e* may be manufactured from a common material, such as metal, cast iron, steel, gas assisted frame, plastic, nylon, vinyl, carbon fiber, composite material, laminates, wood, a combination of any of these, etc. Alternatively, the frame 885*e*, the first spring attachment 816*e* having a plurality of spring hooks 817*e*, the second spring attachment 893*e* having a plurality of spring hooks 891*e*, the first frame bracket 892*e* and the second frame bracket 894*e* may be manufactured as separate components, each component being manufactured of either metal, cast iron, steel, gas assisted frame, plastic, nylon, vinyl, carbon fiber, composite material, laminates, wood, a combination of any of these, etc. The bottom support structure 800*f* may include a frame 885*f*, a first spring attachment having a plurality of spring hooks 817*f*, a second spring attachment having a plurality of spring hooks 891*f*, first frame bracket 892*f* and a second frame bracket 894*f*. The plurality of spring hooks 817*f*, 891*f* may include a plurality of spring bushings 818*f*, 899*f*, respectively.

The bottom frame structure 800*g* may include a frame 885*g*, a second spring attachment having a plurality of spring hooks 891*g* and a second frame bracket 894*g*. The plurality of spring hooks 891*g* may include a plurality of spring bushings 899*g*. The frame 885*g* may have a thickness 886*g* that may extend from a bottom surface 888*g* to a top surface 887*g*. The bottom support structure 800*h* may include a frame 885*h*, a second spring attachment having a plurality of spring hooks 891*h* and a second frame bracket 894*h*. The bushing 899*j* may include a spring receptacle 895*j*. The bushing 899*j* may be made of a hard rubber, a vinyl, a plastic, or other such material that prevents sound when the corresponding spring 895*b* moves relative the spring hooks 817*b*, 891*b*.

The bottom frame structure 800*k* may include a frame 885*k* and a first spring attachment 893*k* having a plurality of spring hooks 891*k*. The bottom support structure 800*l* may include a frame 885*l*. The spring 800*m* may include a plurality of coils 895*m*. The spring attachment 800*n* may include a plurality of spring hooks 891*n* formed in a material 893*n*.

Figure 9A:
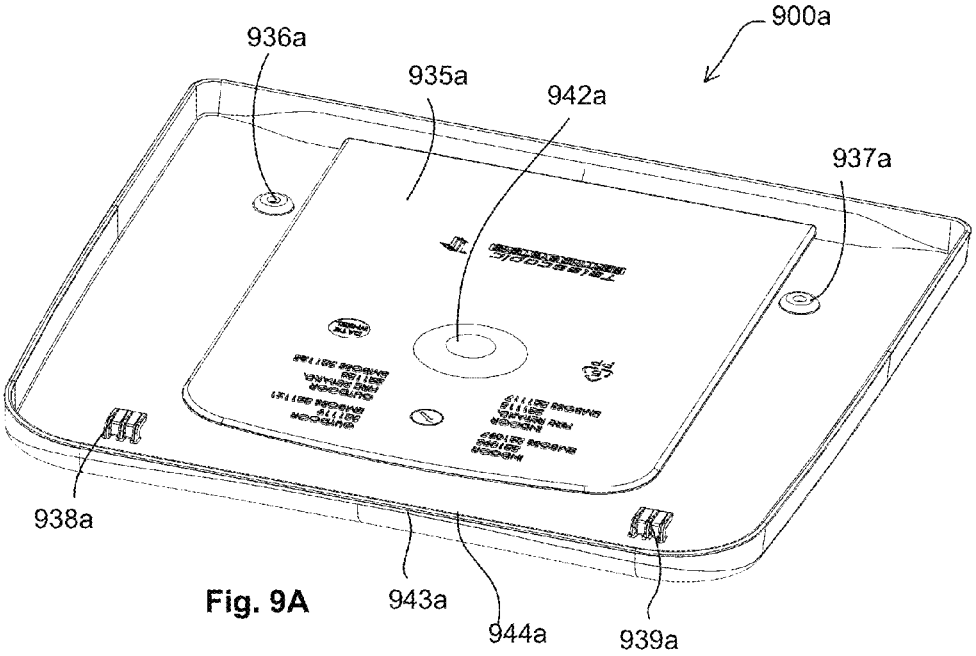
FIGS. 9A and 9B depict perspective views of an example chair pan for use in a foldable chair.
Figure 9B:
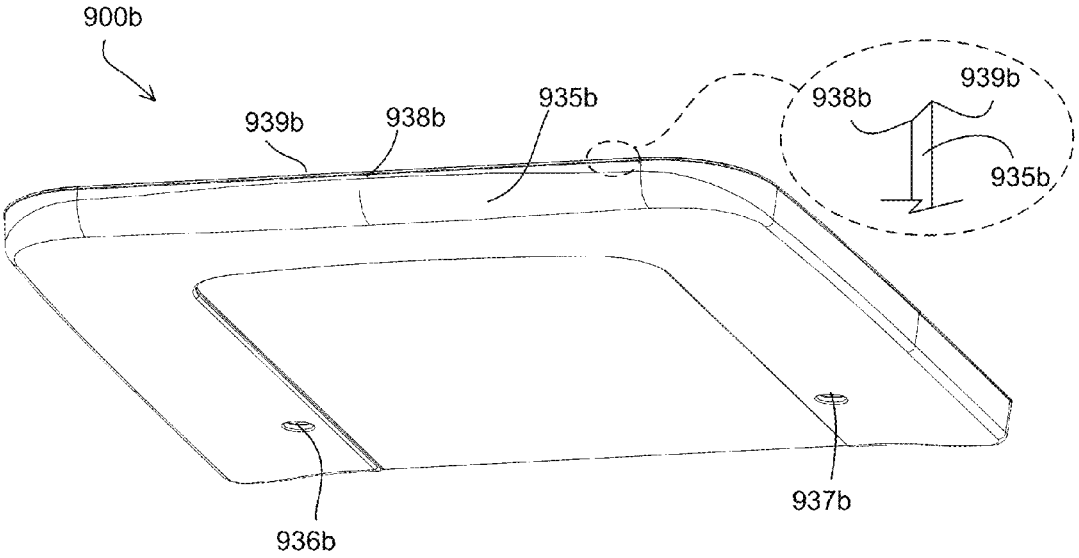

Turning to FIGS. 9A and 9B, top and bottom perspective views of a bottom pan 900*a*, 900*b* are depicted, respectively. The bottom pan 900*a*, 900*b* may be similar to bottom pan 535*a* of FIG. 5A. The bottom pan 900*a*, 900*b* may include a top surface 935*a*, a first hook 937*a*, a second hook 938*a*, a first hole 936*a*, 936*b* and a second hole 937*a*, 937*b*. The bottom pan 900*a* may further include a mold plug 942*a*, a bottom surface 935*b* and a peripheral lip 944*a*, 939*b* that extends inwardly from a side portion 943*a*, 938*b*. The peripheral lip 944*a*, 939*b* may be angled such that an occupant of a corresponding folding chair (e.g., folding chair 142*e* of FIG. 1E) is inhibited from breaking the bottom pan 900*a*, 900*b* from a corresponding bottom occupant support (e.g., bottom occupant support 230 of FIG. 2). A back pan may be constructed similar to the bottom pan 900*a*, 900*b*.

A frame structure 800*a* and membrane 886*b* may be substantially ridged, allowing only limited movement of a support spring 895*b* relative to the membrane 886*b*. The frame structure 800*a*, support spring, and/or the membrane 886*b*, may facilitate attachment of a lower decorative, outer panel (e.g., bottom pan 900*a*). A surface of the membrane 886*b*, that is substantially rigid and may be offset from the top surface of the frame structure 800*a*. The membrane 886*b* may be decorative in, and of itself. For example, a gas assisted (or blow) molded plastic frame structure 800*a* and membrane 886*b* may be formed as a unitary piece.

The frame structure 800*a* and membrane 886*b* may cooperate to provide structural rigidity within a chair 142*f*. The frame structure 800*a* and membrane 886*b* may further cooperate to provide occupant support. Alternatively, the frame structure 800*a* may provide structural rigidity and a support spring assembly 895*b* may provide occupant support. In either event, a cushion 600*a* may be supported by the membrane 886*b* or a support spring assembly 895*b*. The membrane 886*b* may be configured as a center panel, below a top surface of the frame structure 800*a*, and the center panel may be load bearing. For example, a cushion 600*a* may be placed on the membrane 886*b* (or center panel) and may bear the load of a chair occupant. The frame structure 800*a*, and/or the membrane 886*b*, may be formed from a combination of materials. The membrane 886*b* (or center panel) may be an outer decorative panel or may provide a mounting surface for an outer decorative panel (i.e., a back pan 900*a* or a bottom pan). Thereby, an occupant support may utilize the space below the top of the frame surface for occupant comfort.

The back pan 900*a* or bottom pan 900*a* may provide a rigid, durable outer decorative surface on the side opposite the occupant that: may prevent wear to the chair cover and cushion 600*a* due to patrons moving past an unoccupied seat; may prevent wear to the chair cover and cushion 600*a* due to the chair 142*f* contacting adjacent surfaces when the chair 142*f* is stowed away within a telescopic seating structure; may prevent movement of an outer surface affecting occupant comfort as in the case of a patron in a second chair 142*f*, behind the occupant's chair 142*f*, pushing on the rear of the occupant's chair 142*f*.

Utilization of the space between the top of the frame structure 800*a* and the rigid membrane 886*b* support surface greatly enhances occupant comfort by increasing the amount the spring assembly 895*b* and/or cushion 600*a* can deflect and conform to the occupant. When implemented with a resilient member, such as a spring assembly 895*b* and/or with a compliant member, such as a foam cushion 600*a*, the resilient member may have a support frame with curved surfaces which prevent undue forces being transferred to an occupant. For example, a frame structure 800*a* may be contoured and or have a varied profile that conforms to a typical human.

While the figures illustrate a tubular frame structure 800*a*, the frame structure 800*a* may be formed from a sheet of material. Alternatively, the frame structure 800*a* may be formed from multiple sheets of material and joined together after individual formation. As another alternative, the frame structure 800*a* may be molded with or without co-molded reinforcing members. Yet further, a frame structure 800*a* and/or membrane 886*b* may be configured to flex and move along with the resilient support members (i.e., spring assembly 895*b* and/or cushion 600*a*). In any event, the frame structure 800*a* is not limited by materials or construction. While the frame structure 885*b* may be shown in FIG. 8B to include a generally circular cross-section, it should be understood that the cross-sections of the frame structure 885*b* may define a rectangular shape, a square shape, a triangular shape, an oval shape, etc.

Figure 10A:
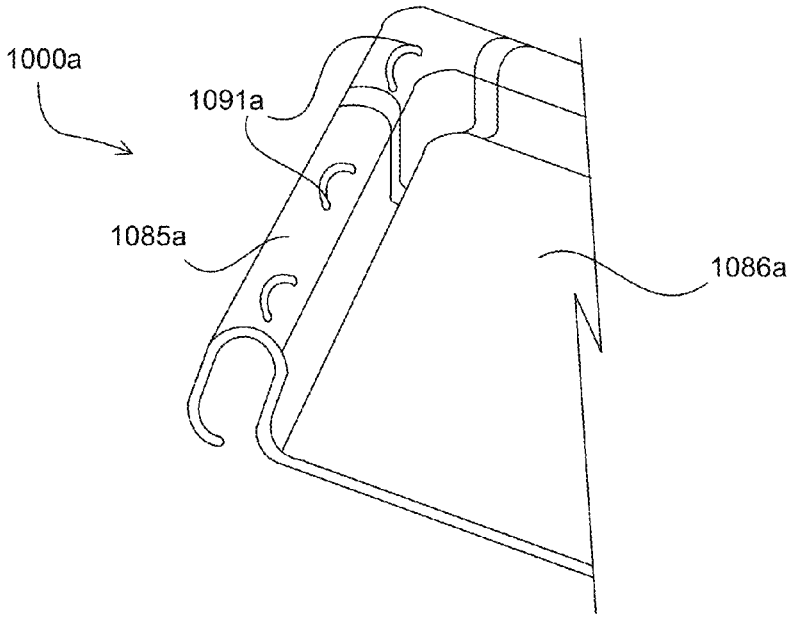
FIGS. 10A-10H depict various sectional views of example components for use in a chair occupant support structure.

With reference to FIGS. 10A-10H, various sectional views are depicted of occupant support structures 1000*a*-1000*h*. The occupant support structures 1000*a*-1000*h* may, for example, be similar to the frame structures 585*a* and membrane 586*a* of FIG. 5A. FIG. 10A depicts an occupant support structure 1000*a* that may include a frame structure 1085*a* and a membrane 1086*a* integrally formed from a single piece of material (e.g., metal, steel, cast iron, plastic, a gas assisted molded plastic, injection molded plastic, fiberglass, carbon fiber, composite, etc.). As depicted in FIG. 10A, a cross-section of the frame structure 1085*a* may generally define a C-shape. The frame structure 1085*a* may include integrally formed spring hooks 1091*a*. While the spring hooks 1091*a* are shown to be formed at a surface define by a top side of the frame structure 1085*a*, it should be understood that the spring hooks 1091*a* may be below the surface defined by the top side of the frame structure 1085*c* toward the membrane 1085*a*. An outer surface of the membrane 1086*a* may define a decorative face.

Figure 10B:
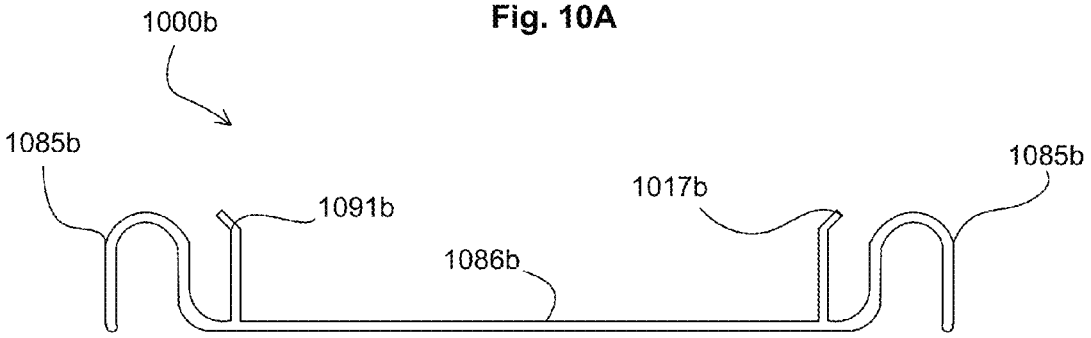

FIG. 10B depicts an occupant support structure 1000*b* that may include an integrally formed frame structure 1085*b*, membrane 1086*b* and spring hooks 1091*b*, 1017*c*. As depicted in FIG. 10B, a cross-section of the frame structure 1085*b* may generally define a U-shape. Similar to the spring attachments 893*a*, 816*a* and spring hooks 891*a*, 817*a* of FIG. 8A, the spring attachments/spring hooks 1091*b*, 1017*b* may support a spring assembly (not shown in FIG. 10B) above the membrane 1086*b*, such that the spring assembly may extend into toward to membrane 1086*b* to conform to at least a portion of a profile of an occupant. While the spring attachments/spring hooks 1091*b*, 1017*b* are shown to extend to a surface define by a top side of the frame structure 1085*b*, it should be understood that the spring attachments/spring hooks 1091*b*, 1017*b* may be below the surface defined by the top side of the frame structure 1085*b* toward the membrane 1086*b*. An outer surface of the membrane 1086*b* may define a decorative face.

Figure 10C:
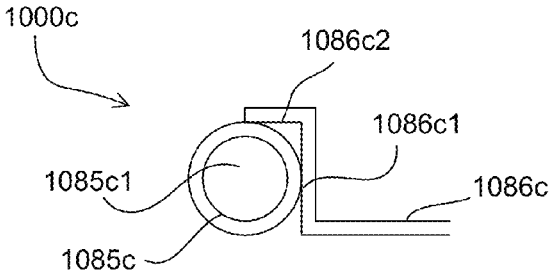
Figure 10D:
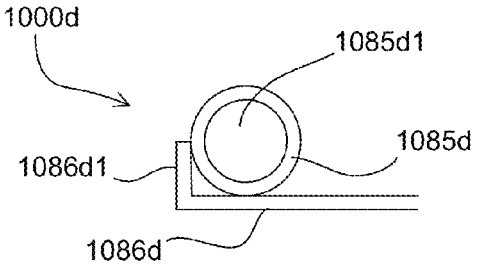

FIGS. 10C and 10D depict occupant support structures 1000*c*, 1000*d* that may include a frame structure 1085*c*, 1085*d* and membrane 1086*c*, 1086*d*, respectively, formed from multiple pieces of material. The frame structure 1085*c*, 1085*c* material may be, for example, metal, wood, steel, cast iron, plastic, gas assisted molded plastic, injection molded plastic, fiberglass, carbon fiber, composite, etc. When the frame structure 1085*c*, 1085*d* is formed from a gas assisted molded plastic, the pocket 1085*c*1, 1085*d*1 may be filled with a material, such as foam, plastic, metal, wood, fiberglass, carbon fiber, composite, etc. The membrane 1086*c*, 1086*d* may be, for example, metal, wood, steel, cast iron, plastic, gas assisted molded plastic, injection molded plastic, fiberglass, carbon fiber, composite, etc. An outer surface of the membrane 1086*c* may define a decorative face. While the frame structures 1085*c*, 1085*d* may be shown in FIGS. 10C and 10D, respectively, to include a generally circular cross-section, it should be understood that the cross-sections of the frame structures 1085*c*, 1085*d* may define a rectangular shape, a square shape, a triangular shape, an oval shape, etc.

Figure 10E:
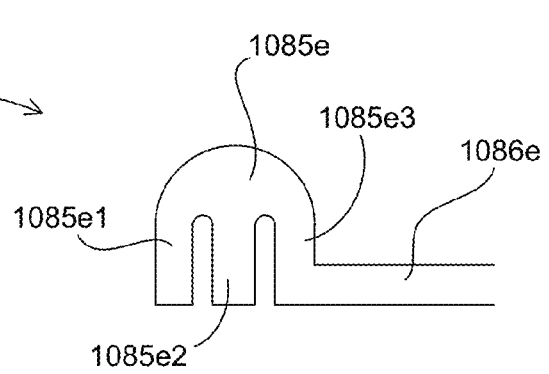

FIG. 10E depicts an occupant support structure 1000*e* that may include an integrally formed frame structure 1085*e* and membrane 1086*e*. The frame structure 1085*e* may include a first finger portion 1085*e*1, a second finger portion 1085*e*2 and a third finger portion 1085*e*3, the number of fingers and their shape not being limited by this example, that may be configured to impart structural strength and rigidity to the frame structure 1085*e*. The occupant support structure 1000*e* may be formed from, for example, metal, wood, steel, cast iron, plastic, gas assisted molded plastic, injection molded plastic, fiberglass, carbon fiber, composite, etc. An outer surface of the membrane 1086*e* may define a decorative face.

Figure 10F:
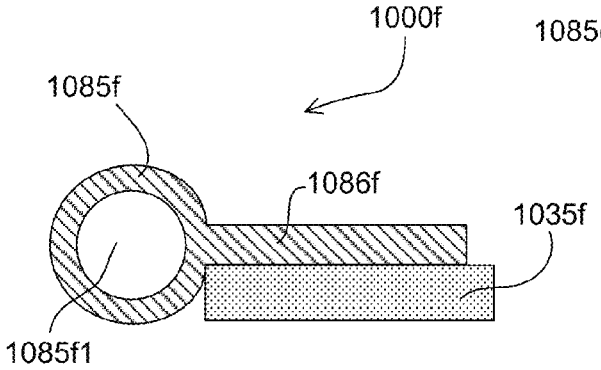

FIG. 10F depicts an occupant support structure 1000*f* that may include an integral frame structure 1085*f* and membrane 1086*f* formed from a gas assisted molded plastic, for example. The frame structure 1085*f* may, thereby, include a pocket 1085*f*1. The pocket 1085*f*1 may be filled with a material, such as, for example, metal, wood, steel, cast iron, plastic, fiberglass, carbon fiber, composite, etc. As shown in FIG. 10F, the membrane 1086*f* may extend from the frame structure 1085*f* midway between an upper surface of the frame structure 1085*f* and a lower surface of the frame structure 1085*f*. The occupant support structure 1000*f* may further include a pan 1035*f* that may be attached to the occupant support structure 1000*f* with, for example, snaps, fasteners, interference fit to the frame structure 1085*f*, etc. The an outer surface of the pan 1035*f* may define a decorative face. While the frame structure 1085*f* may be shown in FIG. 10F to include a generally circular cross-section, it should be understood that the cross-sections of the frame structure 1085*f* may define a rectangular shape, a square shape, a triangular shape, an oval shape, etc.

Figure 10G:
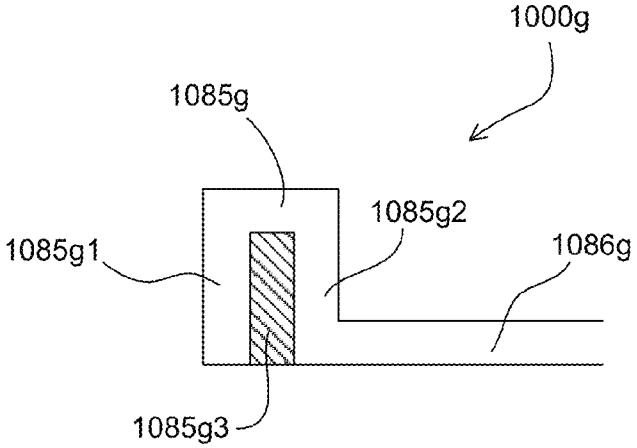

FIG. 10G depicts an occupant support structure 1000*g* that may include an integrally formed frame structure 1085*g* and membrane 1086*g*. The frame structure 1085*g* may include a first finger portion 1085*g*1 and a second finger portion 1085*g*2 that may be configured to impart structural strength and rigidity to the frame structure 1085*g*. The occupant support structure 1000*g* may be formed from, for example, metal, wood, steel, cast iron, plastic, gas assisted molded plastic, injection molded plastic, fiberglass, carbon fiber, composite, etc. The occupant support structure 1000*g* may further include a structural member 1085*g*3, fit between the first finger portion 1085*g*1 and a second finger portion 1085*g*2 that may be configured to impart further strength and rigidity to the frame structure 1085*g*. The structural member 1085*g*3 may be formed from, for example, metal, wood, steel, cast iron, plastic, gas assisted molded plastic, injection molded plastic, fiberglass, carbon fiber, composite, etc. The structural member 1085*g*3 may be co-molded with the occupant support structure 1000*g*. Alternatively, the structural member 1085*g*3 may be friction fit between the first finger portion 1085*g*1 and the second finger portion 1085*g*2 or fastened to the first finger portion 1085*g*1 and/or the second finger portion 1085*g*2. An outer surface of the membrane 1086*g* may define a decorative face. The number of fingers and their shape and the number of structural members is not limited by this example.

Figure 10H:
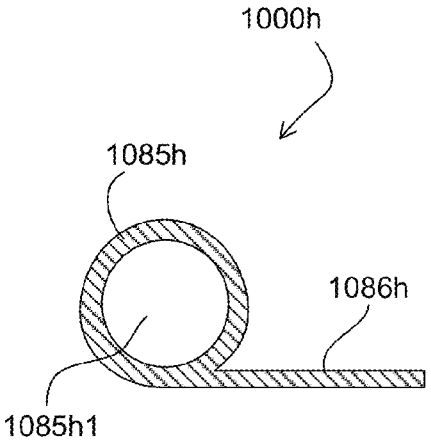

FIG. 10H depicts an occupant support structure 1000*h* that may include an integral frame structure 1085*h* and membrane 1086*h* formed from a gas assisted molded plastic, injection molded plastic, for example. The frame structure 1085*h* may, thereby, include a pocket 1085*h*1. The pocket 1085*h*1 may be filled with a material, such as, for example, metal, wood, steel, cast iron, plastic, gas assisted molded plastic, injection molded plastic, fiberglass, carbon fiber, composite, etc. As shown in FIG. 10H, the membrane 1086*h* may extend from the frame structure 1085*h* near a lower surface of the frame structure 1085*h*. An outer surface of the membrane 1086*h* may define a decorative face. While the frame structure 1085*h* may be shown in FIG. 10H to include a generally circular cross-section, it should be understood that the cross-sections of the frame structure 1085*h* may define a rectangular shape, a square shape, a triangular shape, an oval shape, etc.

Figure 11A:
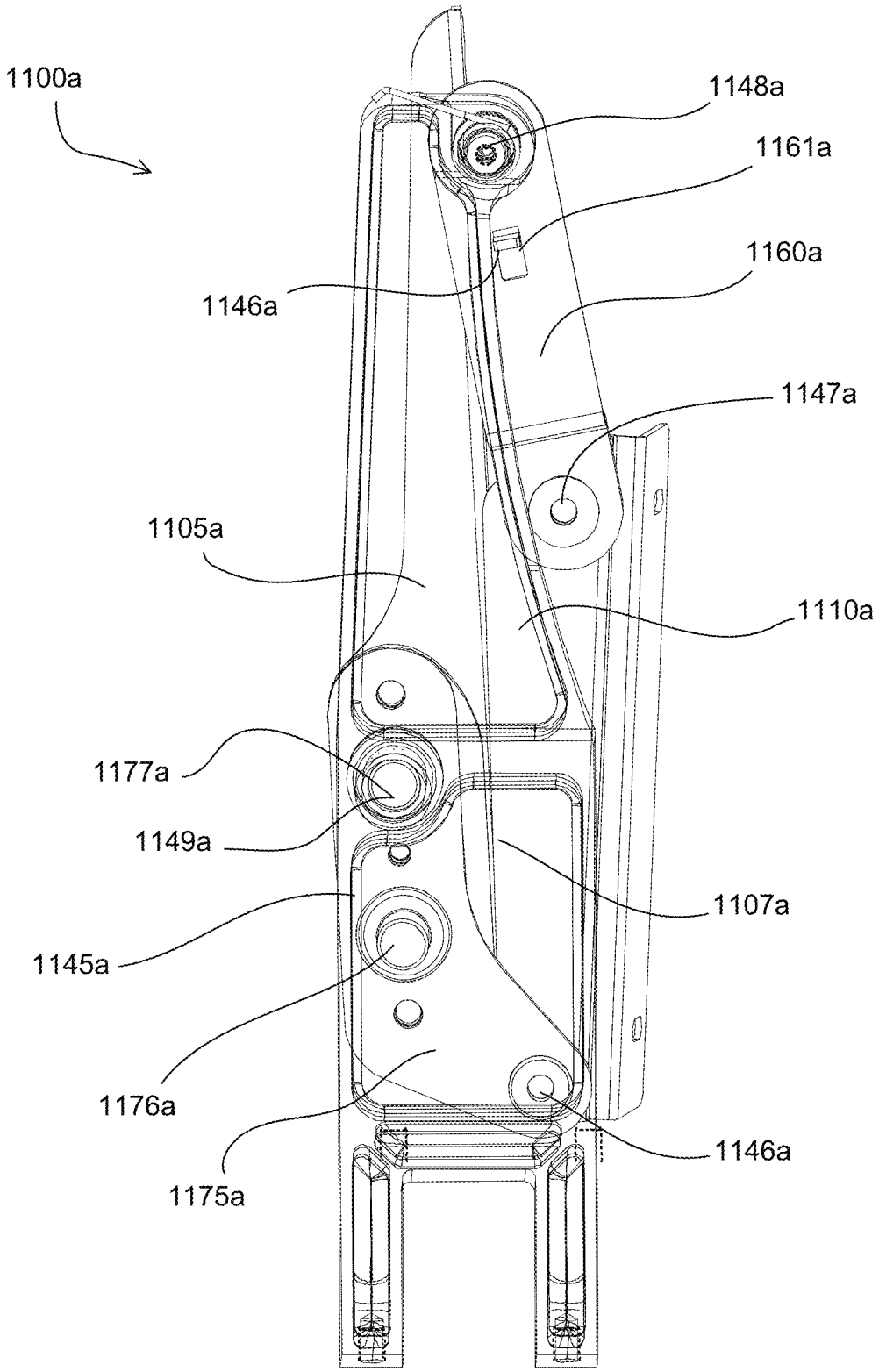
FIGS. 11A-11C depict components of a foldable chair related to an example close position limiter.
Figure 11B:
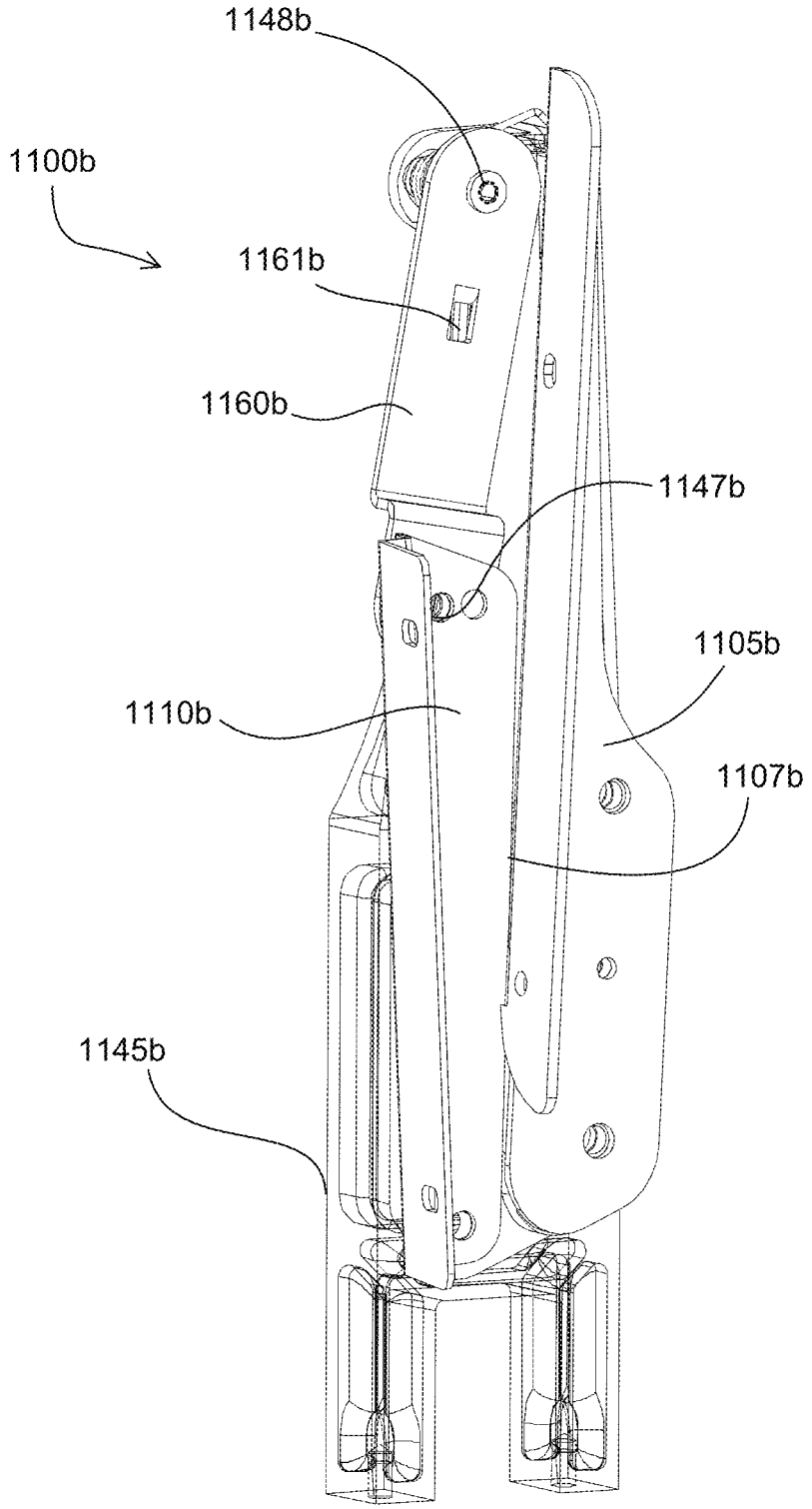
Figure 11C:
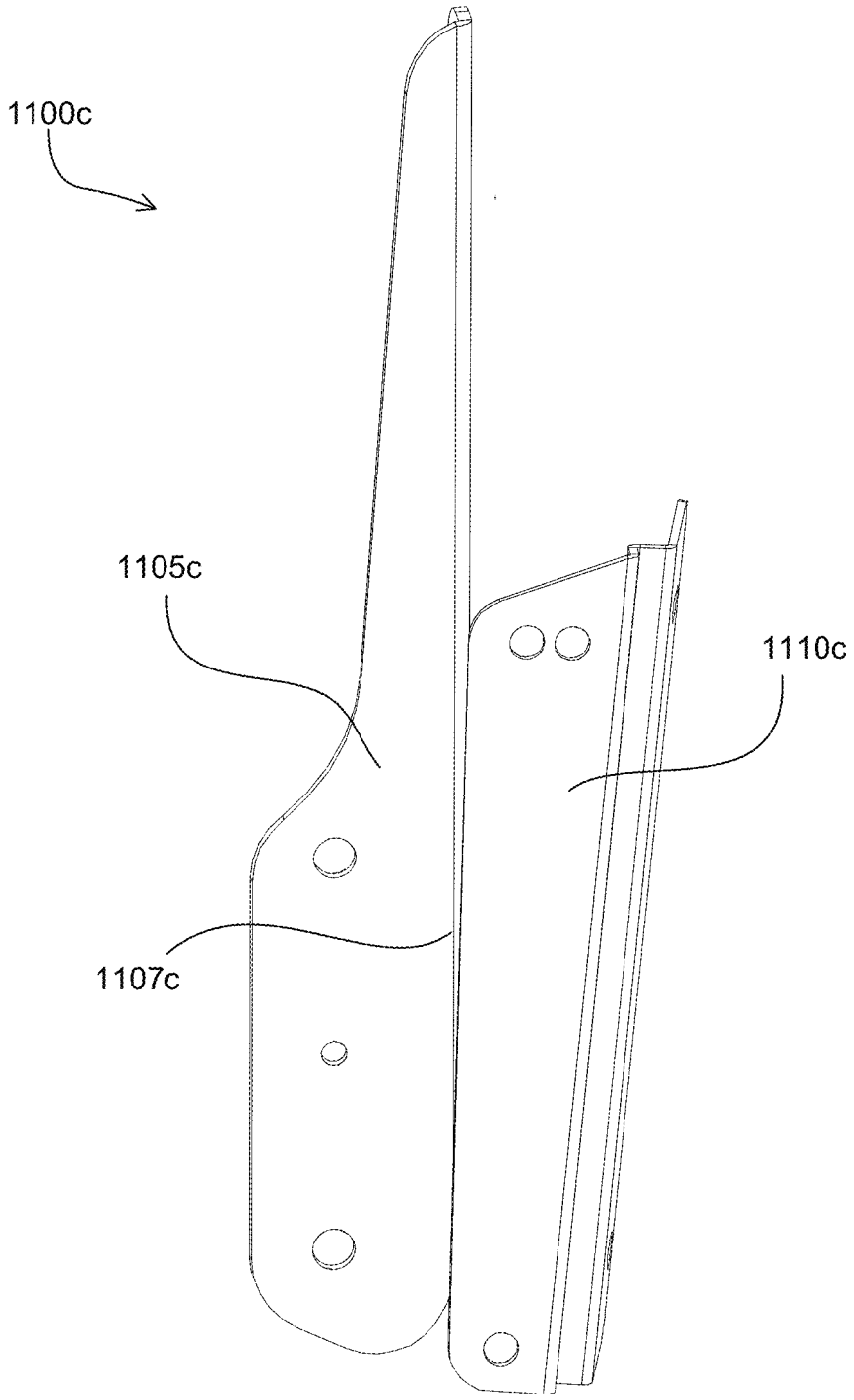

Turning to FIGS. 11A-11C, various components of a foldable chair 110*a* related to a close position limiter 1000*a*, 1000*b*, 1000*c* are depicted. FIG. 11A depicts a close position limiter 1100*a* that may include a seat hinge 1105*a* and a back wing 1110*a* in a closed relationship with respect to one another. As can be seen in FIG. 11A, the set hinge 1105*a* and the back wing 1110*a* abut one another along an intersecting edge 1107*a*. The close position limiter may further include a standard 1145*a* and an armrest link 1160*a* having a close position stop 1161*a*. As can be seen in FIG. 11A, the close position stop 1161*a* may intersect with the standard 1145*a* at the intersection 1146*a*. The intersecting edge 1107*a* and/or the intersection 1146*a* may function as a close position limiter 1100*a*. The armrest link 1160*a* may be pivotally connected to the arm rest via a first pivot connection 1147*a*. The armrest link 1160*a* may be pivotally connected to the back wing 1110*a* via a second pivot connection 1148*a*. The close position limiter 1100*a* may further include a bottom bracket 1175*a* having a first post 1176*a* and a second post 1177*a*. The second post 1177*a* may be inserted within a standard socket 1149*a* to pivotally secure the bottom bracket 1175*a* to the standard 1145*a*. The bottom bracket 1175*a* may be pivotally secured to the back wing 1110*a* via a third pivot connection 1146*a*. The first post 1176*a* and or the third pivot connection 1146*a* may be configured to cooperate with the standard 1145*a* to limit chair movement.

FIG. 11B depicts a close position limiter 1100*b* including an armrest link 1160*b* pivotally connected to the arm rest via a first pivot connection 1147*b*. The armrest link 1160*b* may be pivotally connected to the back wing 1110*b* via a second pivot connection 1148*b*. The armrest link 1160*b* may include a close position stop 1161*b*. The position of the close position stop 1116*b* is not limited to a tab formed, attached or otherwise constructed to the internal portion of the back wing 1110*b*. The close position stop 1161*b* may be incorporated into other portions of the armrest link 1160*b* or standard 1145*b* in a fashion to limit chair movement. The close position limiter 1100*b* may further include a standard 1145*b*. The close position limiter 1100*b* may further include a seat hinge 1105*b* and a back wing 1110*b* in a closed relationship with respect to one another. As can be seen in FIG. 11B, the set hinge 1105*b* and the back wing 1110*b* abut one another along an intersecting edge 1107*b*. The intersecting edge 1107*b* may function as a close position limiter 1100*b*.

FIG. 1100*c* depicts a close position limiter 1100*c* including a seat hinge 1105*c* and a back wing 1110*c* in a closed relationship with respect to one another. As can be seen in FIG. 11C, the set hinge 1105*c* and the back wing 1110*c* abut one another along an intersecting edge 1107*c*. The intersecting edge 1107*c* may function as a close position limiter 1100*c*.

This detailed description is to be construed as exemplary only and does not describe every possible embodiment, as describing every possible embodiment would be impractical, if not impossible. One could implement numerous alternate embodiments, using either current technology or technology developed after the filing date of this application.

What is claimed is:

1. A telescopic seating system, comprising:

a plurality of foldable chairs, each foldable chair comprises a structural frame having a first surface defined by a first side of the structural frame, a second surface defined by a second side of the structural frame, a first post and a second post, wherein the first and second post are for pivotally securing the structural frame to a standard;

each foldable chair comprises an occupant support having a membrane attached to the second surface of the structural frame;

each foldable chair comprises a pan attached to the membrane, wherein a surface of the pan defines an outer decorative surface of the foldable chair; and each foldable chair comprises a cushion supported by the membrane, wherein the cushion substantially fills a space defined as being between the first surface and the second surface of the structural frame.

2. The telescopic seating system of claim 1, wherein a surface of the membrane of each foldable chair defines a decorative outer surface of the respective foldable chair.

3. The telescopic seating system of claim 2, where the occupant support of each foldable chair defines a seat portion of the respective foldable chair and each foldable chair further comprises a second occupant support defining a back portion of the respective foldable chair, wherein a surface of each second occupant support defines a second decorative outer surface of the respective foldable chair.

4. The telescopic seating system of claim 3, wherein the first decorative outer surface and the second outer surface of each foldable chair defines a guide portion that encourages the respective foldable chair to fold up when the guide portion contacts a portion of a telescopic structure.

5. The telescopic seating system of claim 1, wherein each foldable chair further comprises a pan attached to the respective membrane, wherein a surface of each pan defines an outer decorative surface of the respective foldable chair.

6. The telescopic seating system of claim 5, where the occupant support of each foldable chair defines a seat portion of the respective foldable chair and each foldable chair further comprises a second occupant support defining a back portion of the respective foldable chair, wherein a surface of each second occupant support defines a second decorative outer surface of the respective foldable chair.

7. The telescopic seating system of claim 3, wherein the first decorative outer surface and, or the second outer surface of each foldable chair defines a guide portion that encourages the second outer surface of the respective foldable chair to pivot relative the first outer surface of the respective foldable chair when the guide portion contacts a portion of a telescopic structure.

8. A foldable chair, comprising:

a structural frame having a first surface defined by a first side of the structural frame, a second surface defined by a second side of the structural frame, a first post and a second post, wherein the first and second post are for pivotally securing the structural frame to a standard;

an occupant support having a membrane attached to the second surface of the structural frame;

a pan attached to the membrane, wherein a surface of the pan defines an outer decorative surface of the foldable chair; and a cushion supported by the membrane, wherein the cushion substantially fills a space defined as being between the first surface and the second surface of the structural frame.

9. The foldable chair of claim 8, wherein a top surface of the cushion is contoured to conform to at least a portion of a profile of an occupant.

10. The foldable chair of claim 8, further comprising a first plate between the first post and the structural frame and a second plate between the second post and the structural frame.

11. The foldable chair of claim 8, wherein the occupant support is configured as a seat portion of the foldable chair and the foldable chair further comprises a back portion of the foldable chair.

12. The foldable chair of claim 8, further comprising a second occupant support, wherein the second occupant support comprises a second structural frame, the second occupant support further comprises support springs attached to the second structural frame, the second occupant support further comprises a second membrane, wherein the second membrane is configured to limit the movement of the support springs.

13. The foldable chair of claim 12, wherein the occupant support is configured as a seat portion of the foldable chair and the second occupant support is configured as a back portion of the foldable chair.

14. The foldable chair of claim 12 wherein the second structural frame comprises a spring attachment which extends beyond the support springs in a manner which strengthens the second structural frame.

15. The foldable chair of claim 8 further comprising a plurality of spacer plates configured to vary a width and/or height of the occupant support, wherein the spacer plates allow seat width to be adjusted after upholstery of the seat structure.

16. The foldable chair of claim 15, wherein the spacer plates are attached with bolts shared with respective hinge pivot plates.

17. The foldable chair of claim 15, wherein the cushion comprises pockets that, at least partially, conceal the spacer plates and or hinge support plates.

18. The foldable chair of claim 8, further comprising a back bracket that cooperates with a hinge support plate, a hinge plate, or a spacer to limit chair movement.

19. The foldable chair of claim 8, further comprising a standard and a back bracket, wherein the standard and the back bracket cooperate to limit chair movement.

20. The foldable chair of claim 8, wherein the membrane comprises at least one of: features that retain an outer decorative panel; features that limit noise; features that accommodate differing thicknesses of the adjacent panels; and features to secure upholstering covers.

21. The foldable chair of claim 12, wherein one of the occupant support and the second occupant support is configured as a back of the foldable chair and the other is configured as a seat of the foldable chair.

* * * * *